US008051764B2

(12) United States Patent
Jacobsen et al.

(10) Patent No.: US 8,051,764 B2
(45) Date of Patent: Nov. 8, 2011

(54) FLUID CONTROL SYSTEM HAVING SELECTIVE RECRUITABLE ACTUATORS

(75) Inventors: Stephen C. Jacobsen, Salt Lake City, UT (US); Marc Olivier, Sandy, UT (US)

(73) Assignee: Raytheon Company, Waltham, MA (US)

( * ) Notice: Subject to any disclaimer, the term of this patent is extended or adjusted under 35 U.S.C. 154(b) by 793 days.

(21) Appl. No.: 12/074,261

(22) Filed: Feb. 28, 2008

(65) Prior Publication Data

US 2008/0216645 A1 Sep. 11, 2008

Related U.S. Application Data

(60) Provisional application No. 60/904,246, filed on Feb. 28, 2007.

(51) Int. Cl.
*F15B 11/028* (2006.01)
*F15B 13/04* (2006.01)
*F01B 9/00* (2006.01)

(52) U.S. Cl. ..... 91/519; 91/530; 92/137

(58) Field of Classification Search ..... 91/519, 91/530; 92/67, 120, 137
See application file for complete search history.

(56) References Cited

U.S. PATENT DOCUMENTS

| | | | |
|---|---|---|---|
| 204,828 | A | 6/1878 | Jenkins |
| 2,861,550 | A | 11/1958 | Hanna et al. |
| 3,566,919 | A | 3/1971 | Vanderlaan |
| 3,583,422 | A | 6/1971 | Dach |
| 3,593,522 | A | 7/1971 | Angert |
| 3,628,554 | A | 12/1971 | Wilson |
| 3,732,887 | A | 5/1973 | Hayner |
| 3,882,551 | A | 5/1975 | Helmer et al. |
| 3,894,712 | A | 7/1975 | Millar et al. |
| 3,927,602 | A | 12/1975 | Strauff |
| 3,986,353 | A | 10/1976 | Otsubo et al. |
| 4,067,357 | A | 1/1978 | Ruchser |
| 4,069,843 | A | 1/1978 | Chatterjea |
| 4,131,130 | A | 12/1978 | Ruby |
| 4,142,612 | A | 3/1979 | Riddel |
| 4,150,543 | A | 4/1979 | Helmer et al. |
| 4,203,465 | A | 5/1980 | Rissi |
| 4,211,147 | A | 7/1980 | Panissidi et al. |

(Continued)

FOREIGN PATENT DOCUMENTS

DE 10 53 462 3/1959

(Continued)

OTHER PUBLICATIONS

Stephen C. Jacobsen, U.S. Appl. No. 12/074,260, filed Feb. 28, 2008.

(Continued)

*Primary Examiner* — Michael Leslie
(74) *Attorney, Agent, or Firm* — Thorpe North & Western LLP

(57) ABSTRACT

A fluid control or actuation system providing selective recruiting of actuators antagonistic to one another to provide variable output power, such as that used to drive a load. The actuators are intended to comprise different sizes, and to be operable with one or more pressure control valves capable of providing displacement of a non-recruited actuator without requiring active input to cause such displacement. Being able to selectively recruit different sized actuators to drive the load, and being able to displace non-recruited without active input, effectively incorporates a gearing function into the fluid control system.

21 Claims, 10 Drawing Sheets

U.S. PATENT DOCUMENTS

| | | | | |
|---|---|---|---|---|
| 4,266,466 | A | | 5/1981 | Zienms |
| 4,273,030 | A | | 6/1981 | Beeskow et al. |
| 4,286,432 | A | | 9/1981 | Burrows et al. |
| 4,348,159 | A | | 9/1982 | Acheson |
| 4,362,018 | A | | 12/1982 | Torii |
| 4,422,293 | A | | 12/1983 | Ewald |
| 4,478,250 | A | | 10/1984 | Lukasczyk et al. |
| 4,531,369 | A | | 7/1985 | Izumi et al. |
| 4,602,481 | A | * | 7/1986 | Robinson ..... 91/519 |
| 4,611,621 | A | | 9/1986 | Miyakawa et al. |
| 4,657,042 | A | | 4/1987 | Lewis |
| 4,667,571 | A | | 5/1987 | Walters |
| 4,674,539 | A | | 6/1987 | Sloate |
| 4,714,459 | A | | 12/1987 | Hooven |
| 4,774,976 | A | | 10/1988 | Janecke et al. |
| 4,782,859 | A | | 11/1988 | Constantinian |
| 4,819,690 | A | | 4/1989 | Takahashi |
| 4,923,170 | A | | 5/1990 | Takaoka et al. |
| 4,941,508 | A | | 7/1990 | Hennessy et al. |
| 5,011,180 | A | * | 4/1991 | Dunwoody ..... 280/5.507 |
| 5,036,750 | A | | 8/1991 | Katayama |
| 5,058,626 | A | | 10/1991 | Takaoka et al. |
| 5,103,866 | A | | 4/1992 | Foster |
| 5,123,450 | A | | 6/1992 | Wood et al. |
| 5,282,460 | A | | 2/1994 | Boldt |
| 5,317,953 | A | | 6/1994 | Wentworth |
| 5,363,724 | A | | 11/1994 | Asahara et al. |
| 5,385,171 | A | | 1/1995 | Cleasby |
| 5,499,320 | A | | 3/1996 | Backes et al. |
| 5,522,301 | A | | 6/1996 | Roth et al. |
| 5,538,480 | A | | 7/1996 | Torimoto |
| 5,644,967 | A | | 7/1997 | Joerg et al. |
| 5,832,882 | A | | 11/1998 | Matsuda |
| 5,872,893 | A | | 2/1999 | Takenaka et al. |
| 5,924,958 | A | | 7/1999 | Tsuchiya et al. |
| 5,941,795 | A | | 8/1999 | Tsuchiya et al. |
| 6,021,864 | A | | 2/2000 | Sakata et al. |
| 6,223,648 | B1 | | 5/2001 | Erickson |
| 6,269,733 | B1 | | 8/2001 | Reust |
| 6,463,959 | B2 | | 10/2002 | Kremer |
| 6,580,969 | B1 | | 6/2003 | Ishida et al. |
| 6,601,602 | B2 | | 8/2003 | Adler et al. |
| 6,915,230 | B2 | | 7/2005 | Kawai et al. |
| 6,962,220 | B2 | | 11/2005 | Takenaka et al. |
| 6,966,882 | B2 | | 11/2005 | Horst |
| 6,992,456 | B2 | | 1/2006 | Furuta et al. |
| 7,153,242 | B2 | | 12/2006 | Goffer |
| 7,190,141 | B1 | | 3/2007 | Ashrafiuon et al. |
| 7,217,247 | B2 | | 5/2007 | Dariush et al. |
| 7,284,471 | B2 | | 10/2007 | Jacobsen et al. |
| 7,308,848 | B2 | | 12/2007 | Jacobsen et al. |
| 7,313,463 | B2 | | 12/2007 | Herr et al. |
| 7,324,872 | B2 | | 1/2008 | Nagasaka |
| 2002/0026869 | A1 | | 3/2002 | Jenkins |
| 2006/0137519 | A1 | | 6/2006 | Jacobsen et al. |
| 2006/0144218 | A1 | * | 7/2006 | Jacobsen et al. ..... 91/418 |
| 2006/0249315 | A1 | | 11/2006 | Herr et al. |
| 2008/0028924 | A1 | | 2/2008 | Stephenson |

FOREIGN PATENT DOCUMENTS

| | | |
|---|---|---|
| FR | 1 104 952 | 11/1955 |
| FR | 1 524 697 | 5/1968 |
| GB | 997 756 | 7/1965 |
| GB | 1 245 662 | 9/1971 |
| WO | WO 2007/017197 | 2/2007 |
| WO | WO 2008/106611 | 9/2008 |

OTHER PUBLICATIONS

Kawamura S et al., "A new type of pneumatic robot using bellows actuators with force sensing ability" Robotics and Automation, 1994. Proceedings, 1994 IEEE International Conference in San Diego, California, USA May 8-13, 1994, Los Alamitos, CA USA IEEE Comput Soc May 8, 1994 pp. 2451-2456, XP010097488.

Advertisement O + P Olhydraulik und pheumatik, vereinigte fachverlage, Mainz, DE vol. 38, No. 7, Jan. 1, 1994, pp. 388-391, XP000195286.

Schindling, Eva, "Towards Biomimeetic Locomotion in Robotics," Goteborg, Sweden, 2006, pp. 1-18.

Walsh, Conor James, "Biomimetic design of an under-acuated leg exoskeleton for load-carrying augmentation," pp. i-viii and 1-88.

Russell, D.L. et al., "Biomimetic design of low stiffness actuator systems for prosthetic limbs," pp. 1-10.

Carrozza, Maria Chiara, Biomechatronic Design of an exoskeleton for the upper limb, Neurobotics—the fusion of neurosclents and robotics, FP6-IST-001917, www.neurobotics.info, Sep. 23, 2005, Benicassim, Spain, p. 15.

Klute, G. K., et al., Artificial Muscles: Acuators for lower limb prosthese, Pget Sound Health Care Systems, Rehabilitation R&D Center, Seattle VA, Dept of Electrical Engr. and Dept of Rehabilitation Medicine, University of Washington. 1 page.

* cited by examiner

FLUID CONTROL SYSTEM HAVING SELECTIVE RECRUITABLE ACTUATORS

RELATED APPLICATIONS

This application claims the benefit of U.S. Provisional Patent Ser. No. 60/904,246, filed Feb. 28, 2007, and entitled, "Fluid Control System Providing Selective Transmissive Actuation for Variable Output," which is incorporated by reference in its entirety herein.

FIELD OF THE INVENTION

The present invention relates generally to servo and servo-type or fluid control systems. More particularly, the present invention relates to a fluid control system having one or more pressure control valves operable with one or more actuators.

BACKGROUND OF THE INVENTION AND RELATED ART

Fluid control or servo systems, such as hydraulic or pneumatic systems, are well known and operate on the simple principle of transferring force from an applied location to an output location by means of a fluid. In hydraulic systems, the transfer is typically accomplished by means of an actuator cylinder having a piston contained therein pushing a substantially incompressible fluid through a fluid line to another cylinder, also having a piston, at a different location. One tremendous advantage to transferring force through a hydraulic system is that the fluid line connecting the two cylinders can be any length and shape, and can wind or bend as needed between the two pistons. The fluid line can also split into multiple other fluid lines thus allowing a master piston to drive multiple slave pistons. Another advantage of hydraulic systems is that it is very easy to increase or decrease the applied force at the output location through hydraulic multiplication, which is easily accomplished by changing the size of one piston relative to the other.

In most hydraulic systems, cylinders and pistons are connected through valves to a pump supplying high-pressure hydraulic fluid functioning as the substantially incompressible fluid. Spool valves are the most commonly used valves in hydraulic systems and can apply pressure to either the front or back faces of the piston inside the hydraulic actuators. When one side the actuator cylinder is pressurized, the spool valve simultaneously opens a return line to the opposite side of the actuator, allowing the substantially incompressible hydraulic fluid on the opposing side of the piston to bleed back into a return reservoir. This relieves any internal pressure that would oppose the movement of the actuator, and limits the work required by the actuator to only that which is needed to drive the external load. As a result, spool valves are ideally suited to hydraulic systems because they allow efficient control of the flow rate to achieve hydraulic force.

Still, in spite of the advantages of spool valves in hydraulic systems, existing spool valves have certain design limitations. Traditional spool valves have been designed to be actuated by either mechanical levers, electrical servos or internal control pressures called pilot pressures, which are provided by way of a pilot or control valve. Spool valves are commonly mounted in a cylindrical sleeve or valve housing with fluid ports extending through the housing, which can be opened or closed for fluid communication with each other by positioning the lands and recesses of the spool in appropriate locations within the sleeve. The working pressure is varied by displacing the valve spool to open or close the valve allowing varying amounts of pressurized fluid to flow from the supply reservoir.

In the case of electrical actuation, the valve is controlled by an electrical input current from an electrical source. The current may be related to the pressure in the system in that the greater the current supplied, the wider the pressure or supply port is opened allowing pressurized fluid to flow into and through the valve with less restriction. When the load pressure in the actuator finally equals the supply pressure then flow stops. In other words, a given current controls the size of the openings in the pressure or return ports, which in turn controls the flow rate of fluid into or away from the hydraulic actuator. In order for the system to operate correctly, there must a be constant pressure differential across the spool valve. Otherwise, as the load pressure approaches the supply reservoir pressure the valve loses linear response and its operation becomes unstable. Consequently, spool valves are typically operated in systems where the pressure of the source (i.e. the pressurized supply reservoir) is very high compared to the range of opposing load pressures, and the flow versus input current at a given pressure is linear in the usable region.

What this means is that the system, and particularly the load, is always in a pressurized state and cannot be freely moved by an external force or under its own weight. As such, the load cannot easily be moved without actual active input in the form of input pressurized fluid. In other words, the actuator cannot be passively back driven. This is true even for very small movements. Such a configuration is extremely inefficient, as active input in the form of pressurized fluid is required to displace or actuate a load, even in response to non-actuated forces, such as kinetic energy that may exist from the load under gravity or responding to momentum caused by one or more things, such as braking, impact by another object, etc. The use of pressurized fluid creates a significant energy loss as new pressurized fluid must always be supplied in order to facilitate movement within the fluid control system, such as movement and/or braking of the load.

In addition to the current flow problems of traditional spool valves, classical hydraulic systems are problematic for several other reasons. First, complex controllers are needed to control the cycle times of valves and pistons. Second, cycle times for moving pistons are often long because large amounts of fluid are required to move output pistons. Third, the large quantity of fluid needed to drive output pistons requires constant pressurization of large reservoirs of fluid accumulators. Consequently, hydraulic machines typically require large amounts of hydraulic fluid for operation and therefore require large external reservoirs to hold the difference in the volume of fluid displaced by the two sides of any cylinder.

Classical spool valve devices are also limited in application because when a controlled flow is induced through a valve it generally translates directly into a controlled velocity of the actuator's piston. Consequently, complex system feedback devices must be used to convert the hydraulic energy from velocity inputs into a system based on load position. Introducing feed back control devices into the system limits its response to the bandwidth of the feedback loop and the responsiveness of the valves such that the time delays between the feedback devices and the valves make the system unstable when a resistive force is applied.

Still other problems exist with classical servo valves operating in classical servo or fluid control systems. Due to the problems discussed above, these valves and systems are incapable of performing at high bandwidths without going unstable. In addition, significant amounts of energy may be lost due to leakage when not all of the valves in a multiple valve system are being used. Finally, the configuration of the spool can be limiting, with multiple lands and recesses formed in a single spool, and with the single spool functioning to open and close the pressure and return ports formed in the valve body.

As indicated, prior related fluid actuated or control systems, such as robotic and other hydraulic systems, typically require the use of active, pressurized fluid to actuate an actuator to drive or displace a load both actively, and in response to forces acting on the actuator, such as gravity, impacts and/or momentum. The use of active pressurized fluid to provide any movement of the actuators is recognized as a significant waste of energy and as being extremely inefficient. However, significant energy loss and reduced efficiency typically give way to design factors or criteria focused on increased power, which have been perceived as being more important, or at least more desirable. Therefore, the loss of energy and reduced efficiency, in many cases, has not been the foremost or principal design priority. In other words, large and expensive systems have been created for the specific purpose of providing large or high power output although these systems are extremely inefficient.

Another shortfall of prior related fluid control systems relates to the output power and subsequent movement of the load in relation to the needed amount of pressurized fluid to effectuate such movement. Typically, in order to generate high or large amounts of output power (often expressed in terms of linear force or torque) a large volume of pressurized fluid is needed. This is particularly the case when both high output power and high speeds are also desired. With such systems, large amounts of fluid are required to achieve the desired results, further contributing to the inefficiency of the system. This problem is encountered in some mechanical systems, such as those found in vehicles. However, various gearing systems have been designed and implemented to optimize the ratio of output power to speed, thus greatly improving the efficiency of the motors.

SUMMARY OF THE INVENTION

In light of the problems and deficiencies inherent in the prior art, the present invention seeks to overcome these by providing a fluid control or actuation system providing a plurality of selectively recruitable actuators operable with one or more pressure control valves to provide variable output, such as variable actuator and subsequent load output. The recruitable actuators are operable with the pressure control valves, which combination effectively provides a transmission function facilitating what may be described as gearing within the fluid control system. The multiple actuators may be in parallel, of the same or different size, and may be selectively recruited or activated to provide or achieve a desired output.

More specifically, the fluid control system specifically comprises multiple antagonistic, parallel actuators (two or more actuators situated parallel with respect to one another) operable with unique pressure control valves, wherein the actuators may be selectively recruited, preferably using a control algorithm, to provide different actuator output or gears that vary the output to a load operable with the multiple parallel actuators. The multiple actuators preferably comprise different sizes in order to achieve a number of different output levels. As one skilled in the art will recognize, the present invention may be operable within various system types, such as in a tendon drive or other system coupled to and configured to facilitate the driving of a load.

In terms of efficiency and conservation of pressurized fluid, a likely optimal energy savings would be realized when the lowest output force from the smallest pair of parallel actuators is used, as caused by a minimal amount of supplied pressure by the pressure control valve(s). If an increase in output force is required or desired, then higher pressures to the smallest pair of actuators may be supplied until this pair of actuators is unable to provide the needed output power. At this time, a second pair of parallel actuators may be recruited, which comprise a different, larger size than the first pair, and which are capable of a different output force, such as higher torque or faster speeds. Likewise, if still more output force is required than is able to be provided by either of the second pair of parallel actuators, operating alone, respectively, a combination of the first and second pair of parallel actuators may be recruited and activated to produce the desired output. This may be loosely described as shifting gears within the fluid control system.

As embodied and broadly described herein, the present invention resides in a fluid control system adapted to optimize power output for a given operating condition, comprising a load; a first pair of parallel actuators operating antagonistic to one another, and operable with the load; a second pair of parallel actuators operating antagonistic to one another, and operable with the load, the second pair of parallel actuators comprising a different size than the first pair of parallel actuators; at least one pressure control valve operable with each pair of the first and second pairs of parallel actuators and a pressurized fluid source; means for operably coupling the first and second pairs of actuators to the load; and means for selectively recruiting from the first and second pairs of parallel actuators to achieve variable power output, the means for selectively recruiting being capable of separately recruiting and actuating either of the first and second pairs of parallel actuators, as well as a combination of the first and second pairs of parallel actuators. The pressure control valves operable with a non-recruited pair of parallel actuators may be caused to enter a valving state of inactive passivity that permits the non-recruited pair of parallel actuators to displace, without active input, simultaneously with a recruited pair of parallel actuators being actuated by active input.

The present invention also resides in a fluid control system adapted to optimize power output for a given operating condition, comprising a load; a first actuator operable with the load; a second actuator operable with the load, and operating antagonistic to the first actuator, the first and second actuators comprising a different size; a pressure control valve operable with each of the first and second actuators, and a pressurized fluid source; means for operably coupling the first and second actuators to the load; and means for selectively recruiting and actuating either of the first and second parallel actuators to achieve variable power output.

The present invention still further resides in a method for varying power output within a fluid control system operable with a load, the method comprising providing a first pair of parallel actuators operating antagonistic to one another, and operable with the load; providing a second pair of parallel actuators operating antagonistic to one another, and operable with the load, the second pair of parallel actuators comprising a different size than the first pair of parallel actuators; operating at least one pressure control valve with each pair of the first and second pairs of parallel actuators and a pressurized fluid source; coupling the first and second pairs of actuators to the load; and recruiting, selectively, from the first and second pairs of parallel actuators to achieve a variable power output, the recruiting being capable of separately recruiting and actuating either of the first and second pairs of parallel actuators, as well as a combination of the first and second pairs of parallel actuators.

The present invention still further resides in a method for varying power output within a fluid control system operable with a load, the method comprising recruiting a first pair of parallel actuators to achieve a first power output; recruiting a second pair of parallel actuators, different size than the first pair of parallel actuators, to achieve a second power output; recruiting, in combination, the first and second pairs of parallel actuators to achieve a third power output; causing a pressure control valve operable with the second pair of parallel actuators to enter a state of inactive passivity during the recruiting of the first pair of parallel actuators to achieve the first power output; and causing a pressure control valve operable with the first pair of parallel actuators to enter a state of inactive passivity during the recruiting of the second pair of parallel actuators to achieve the second power output.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

DETAILED DESCRIPTION OF EXEMPLARY EMBODIMENTS

Figure 1:
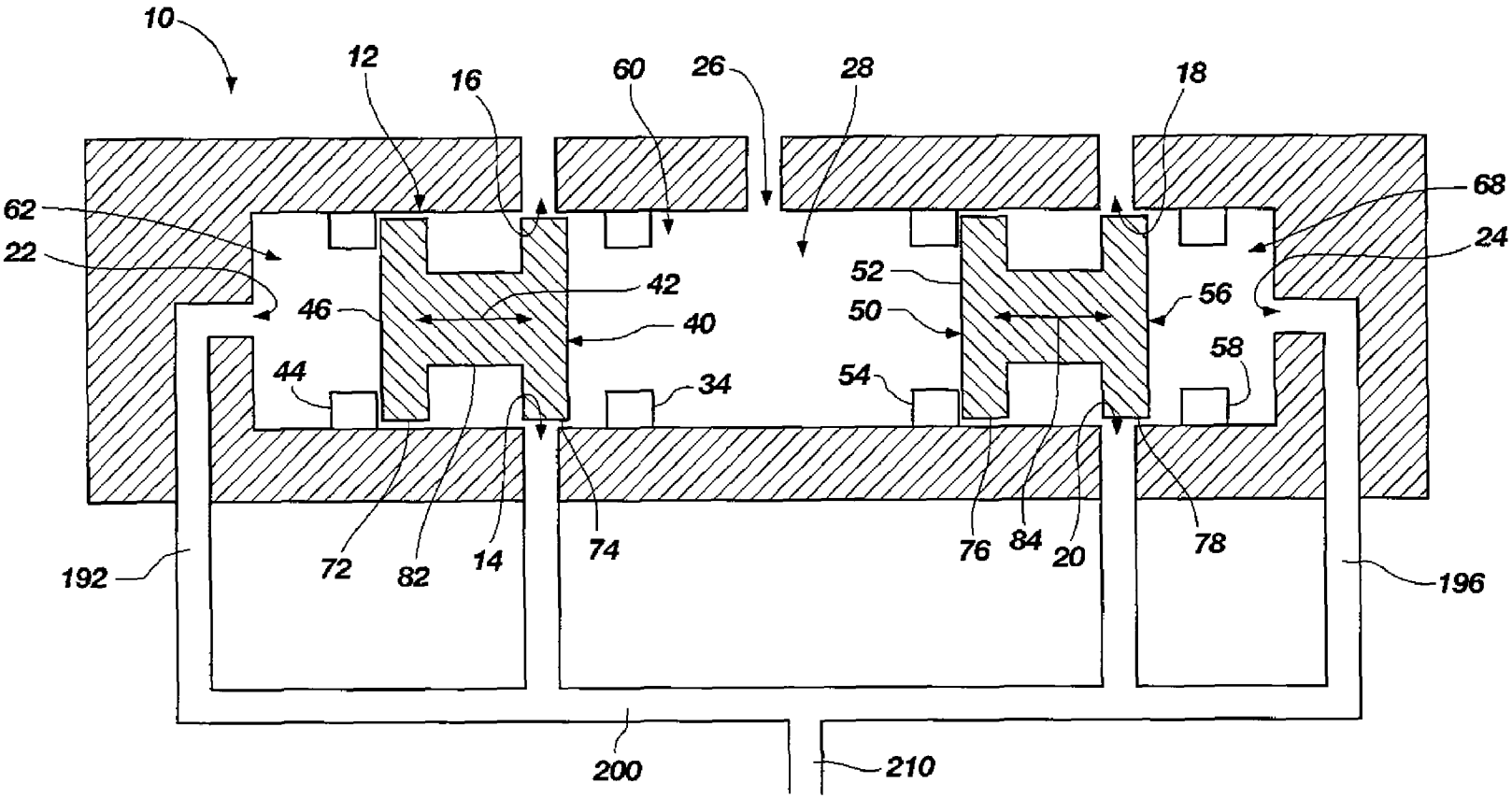
FIG. 1 illustrates a generalized cut-away view, taken along a longitudinal cross-section, of a dual independent spool pressure control valve according to one exemplary embodiment.

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

Preliminarily, the terms "bilateral control" or "bilateral pressure regulation," as used herein, shall be understood to mean the ability of a single pressure control valve to effectuate two-way pressure regulation, meaning that the pressure control valve is able to regulate and control the pressures acting within the actuator on both sides of the actuator piston to displace the piston and therefore drive the load bi-directionally.

The term "pressure differential," as used herein, shall be understood to mean or shall refer to a state of non-equilibrium existing within the system between the pilot pressure and the load pressure. In some embodiments, a "pressure differential" may mean a simple difference in pressure magnitudes between the load pressure and the pilot pressure. In other embodiments, namely those utilizing area reduction for load/force translation or multiplication, a "pressure differential" may mean a non-proportional difference in pressure existing between the load pressure and the pilot pressure, taking into account the different areas of the valve body, the actuator, and any hydraulic multiplication.

The term "load pressure," as used herein, shall be understood to mean the pressure acting within the load actuator as induced or applied by a load, minus the friction or other losses internal to the actuator mechanism itself. The load pressure directly influences and dictates the feedback pressure.

The term "feedback pressure," as used herein, shall be understood to mean the pressure acting upon the feedback pressure sides of the independent return and pressure spools within the pressure control valves as received or dictated by the load pressure after all area reductions/increases and fluid pressure multiplications/divisions have occurred, if any. The feedback pressure may, in some cases, equal the load pressure.

The term "actuator" or "load actuator," as used herein, shall be understood to mean any system or device capable of converting fluid energy into usable energy, such as mechanical energy. A typical example of a load actuator is a hydraulic actuator coupled to a load, wherein the hydraulic actuator receives pressurized hydraulic fluid from a hydraulic fluid source and converts this into mechanical work or a force sufficient to drive the load.

The term "dangle," as used herein, shall be understood to mean the non-actuated free swing of the load in either direction in response to a non-actuated force acting on the load (e.g., one utilizing kinetic energy generated from an external force (an impact), momentum, etc.), wherein the movement of the load is achieved without providing active input from the fluid control system to move the load in either direction, which condition may be referred to as inactive passivity (as compared to the active passivity of prior related fluid control systems. The ability to dangle or free-swing is made possible by the various pressure control valves operating in a "slosh mode."

The term "slosh" or "slosh mode," as used herein, shall be understood to mean the inactive passive valving state of the antagonistic pressure control valves, wherein the pilot or control pressure in each valve is maintained below both the load and feedback pressure and the return reservoir pressure, thus causing the return spools in each valve to displace to and be maintained in the open position opening the return inlets and outlets, as well as causing the pressure spools to be maintained in the closed position closing off pressurized fluid. With the pilot pressure below both the load pressure and the feedback pressure and the return reservoir pressure, and with the pressure and return spools in these positions, local fluid is able to shunt or slosh back and forth between the load actuators and the valves through the open return ports of the pressure control valves in response to movement of the load, and thus the actuator. The shunting of local fluid is done with little or no resistance, thus improving the impedance of the system. In addition, as mentioned, only local fluid may be allowed to shunt back and forth, which means that the system only uses the fluid present in the actuators, the pressure control valves, and the various fluid lines connecting them rather than actively requiring pressurized fluid to enable actuation. Fluid in the pressure supply is neither used nor diluted, thus greatly improving the efficiency of the system.

In the slosh mode, no active input from pressurized fluid (e.g., power) is necessary to influence the dynamics of the actuators and the load in either direction as in prior related servo and fluid control systems. Indeed, prior related systems are only somewhat passive, meaning that some degree of active power or pressurized fluid is still needed to actuate the load in one or both directions, or rather to permit movement of the load in one or both directions. This prior art condition may be termed as "active passivity" because, although the system appears passive, it really is active, even if only slightly.

On the other hand, pressure control valve is capable of inactive passivity. "Inactive passivity" may be referred to as the ability of the pressure control valve, as contained within a servo or servo-type system, to allow the load to move or "dangle" in response to imposed external or internal conditions without any active input or influence from the system other than the operation of the pilot pressure or servo motor which controls the pilot pressure. More specifically, inactive passivity does not require any pressurized fluid from the supply reservoir to permit movement or actuation of the actuators or the load.

The term "output pressure," as used herein, shall be understood to mean the pressure output from a pressure control valve operable with an actuator, wherein the output pressure is supplied to the actuator and converted into an actuating force within the actuator.

The term "tendon drive system," as used herein, shall be understood to mean a system comprising parallel actuators situated and operating antagonistically with respect to one another, wherein the actuators are each operably coupled to one another via a tendon that is operable with a pulley, and wherein the pulley is coupled to a load to facilitate the driving of the load in a bi-rotational or counter-rotational manner. For example, a tendon drive system may comprise two parallel actuators antagonistically situated, each being coupled to a tendon operable with a pulley that is coupled to an appendage (e.g., an arm or leg) of a robot or exoskeleton. Movement of the actuators pulls on the tendons, which rotates the pulley in a corresponding direction to drive the load. It is noted that multiple parallel actuators and multiple tendons and pulleys may be used and configured to utilize the selective variable output of the recruitable actuators discussed herein.

The term "output power," as used herein, shall be understood to mean the operating condition of the load coupled to the actuators, expressed in terms of force or torque of the load as related to the actuation speed or velocity of the load.

Generally speaking, the present invention provides a fluid control system having the ability to vary and control, for optimization purposes, one or more components to supply different levels of output power as pertaining to the load by selectively recruiting from available actuators coupled to the load, and specifically, the ability to select from a number of available actuators to achieve and/or maintain a desired operating condition of the load. As indicated, this ability may be compared to shifting gears within a capable prior system.

The fluid control or valve system comprising various pressure control valves (PCV or PCVs) operable with various actuators, many of which may be sized differently, situated in an antagonistic relationship with one another to provide control of a load, preferably through a tendon drive system, wherein the various actuators are configured for separate and/or collective recruitment to provide the system with different output power levels using a standard pressure or fluid source. The present invention provides the ability to increase the efficiency of the system, namely to reduce the amount of pressurized fluid used to control the movements of the load coupled to the actuators, by progressively going down in reduction, or increasing the reduction ratio, to get the desired amount of output force to displace or move the load while using the minimum amount of pressurized fluid. Different actuators of different size may be selectively recruited to provide the desired output, wherein the system uses the minimal amount of pressurized fluid to obtain this. One or more control algorithms may be used to control the selective recruitment of the actuators and the output of the system, wherein the control algorithm functions to maintain the system in an optimal operating state, namely a desired output and subsequent operating state of the load, which may be accomplished in a variety of ways, such as upon monitoring the performance of the system and making modifications based on feedback.

One exemplary operating environment in which the fluid control system described herein may be particularly well suited is within a robot or exoskeleton, wherein the system functions to control the movements in the various appendages (e.g., the arms and/or legs) of the robot or exoskeleton to enable these to exhibit or imitate more natural, lifelike movements, all while maintaining a high degree of efficiency.

The fluid control or servo system of the present invention provides several significant advantages over prior related valving and servo systems, many of which are set forth herein. Each of these advantages will be apparent in light of the detailed description set forth below, with reference to the accompanying drawings. These advantages are not meant to be limiting in any way. Indeed, one skilled in the art will appreciate that other advantages may be realized, other than those specifically recited herein, upon practicing the present invention.

There are a number of components at work that operate to enable the fluid control system of the present invention to provide variable output power. A discussion on each of these is provided below, beginning with the use of dual independent spool pressure control valves used to supply the actuating or output pressure to the actuators, followed by the use of antagonistic pressure control valves configured to enable inactive passivity within an actuator.

Dual Independent Spool Pressure Control Valves

With reference to FIG. 1, illustrated is a cut-away view, as taken along a longitudinal cross-section, of one exemplary embodiment of a valving system, namely a dual independent spool pressure control valve. Specifically, FIG. 1 illustrates a dual independent spool pressure control valve (PCV) 10 configured for regulating pressure within a closed-loop fluid control system, such as a hydraulic system. In the exemplary embodiment shown, the PCV 10 comprises a valve body 12 consisting of an in-line linear structure having formed therein a return inlet port 14, a return outlet port 16, a pressure inlet port 18, a pressure outlet port 20, first and second feedback ports in the form of a return spool feedback port 22 and a pressure spool feedback port 24, and a pilot pressure port 26. The PCV 10 further comprises dual independent spools, namely return spool 40 and pressure spool 50, commonly disposed within and situated about a longitudinal axis of the valve body 12. Return and pressure spools 40 and 50 are freely disposed and supported within valve body 12 and restricted in movement by one or more limiting means, such as spool stops 34, 44, 54 and 58.

As shown, this particular embodiment of the valve body 12 comprises a cylindrical, tube shape structure having an interior cavity 60 defined therein by the wall segment of the valve body 12. The interior cavity 60 is configured to contain or house each of the pressure and return spools 40 and 50, as well as to accommodate their displacement. Indeed, the interior cavity 60 comprises a diameter or cross-sectional area that is slightly larger than the diameter or cross-sectional area of the return and pressure spools 40 and 50, thus allowing the return and pressure spools 40 and 50 to move bi-directionally therein, as well as to adequately seal against the inside surface of the wall segment of the valve body 12 as needed. The size of the interior cavity 60 with respect to the return and pressure spools 40 and 50 is such that the return and pressure spools 40 and 50 are able to maintain their orientation within the interior cavity 60 as they are caused to displace back and forth therein.

The interior cavity 60, and the return and pressure spools 40 and 50, may also be configured to achieve a sealed relationship. In essence, the valve body 12, and particularly the interior cavity 60, has defined therein various chambers. As shown in FIG. 1, valve body 12 comprises a pilot pressure chamber 28 defined by the distance or area between the return and pressure spools 40 and 50, a return spool feedback chamber 62 defined by the area between the return spool 40 and an end of the valve body 12, and a pressure spool feedback chamber 68 defined by the area between the pressure spool 50 and an opposing end of the valve body 12. Each one of these chambers varies in size depending upon the realized displacement of one or both of the return and pressure spools 40 and 50 during actuation of the PCV. Each of chambers 62 and 68 are sealed from pilot pressure chamber 28 by the interaction of return and pressure spools 40 and 50 with the inside surface of the wall of the valve body 12.

Providing a sealed relationship between the return and pressure spools 40 and 50 with the valve body 12 functions to maintain the integrity of the system by eliminating unwanted fluid crosstalk and pressure leaks. The return and pressure spools 40 and 50 may comprise a sealed relationship to the valve body 12 using any known means in the art. In the embodiment of FIG. 1, acceptable sealing with very low internal leakage is achieved by using very tight manufacturing tolerances. This approach results in very low friction between spools 40 and 50 and the interior walls of valve body 12. Whatever type of sealing arrangement used, however, the return and pressure spools 40 and 50 are to be configured to displace in response to the pressure differentials acting within the system in an attempt to equalize the pilot pressure and the feedback pressure.

Both the return and pressure spools 40 and 50 comprise a geometric configuration or shape that matches or substantially matches or conforms to the geometric configuration or shape of the interior cavity 60 of the valve body 12. As shown, return and pressure spools 40 and 50 are generally cylindrical in shape, and comprise two lands and a recess therebetween, as well as first and second sides. Specifically, in the embodiment shown in FIG. 1, return spool 40 comprises a pilot pressure side 42, a feedback pressure side 46, a first land 72, a second land 74, and a recess 82 extending between lands 72 and 74. Pressure spool 50 comprises a similar geometric configuration or design in that it also comprises a pilot pressure side 52, a feedback pressure side 56, a first land 76, a second land 78, and a recess 84 extending between lands 76 and 78.

As noted above, feedback side 46 of return spool 40 is in fluid communication with return spool feedback chamber 62, while pilot pressure side 42 is in fluid communication with the pilot pressure chamber 28. Lands 72 and 74 comprise a suitable diameter or cross-sectional area so as to be able to seal against the interior wall surface of the valve body 12. As sealed, and during displacement of the return spool 40, lands 72 and 74 minimize fluid communication or fluid crosstalk between feedback chamber 62, recess 82, and pilot pressure chamber 28. In addition, lands 72 and 74 function with recess 82, since it is smaller in diameter than lands 72 and 74, to facilitate the proper flow of fluid through return inlet port 14 to outlet port 16. Once these ports are opened, the fluid flows into the PCV 10 through the return inlet port 14, through the recess 82 of the return spool 40, and out the return outlet port 16.

Also as noted above, feedback side 56 of pressure spool 50 is in fluid communication with pressure spool feedback chamber 68, while pilot pressure side 52 of pressure spool 50 is in fluid communication with the pilot pressure chamber 28. Lands 76 and 78 also comprise a suitable diameter or cross-sectional area so as to be able to seal against the interior wall surface of the valve body 12. As sealed, and during displacement of the pressure spool 40, lands 76 and 78 minimize fluid communication or fluid crosstalk between feedback chamber 68, recess 84, and pilot pressure chamber 28. In addition, lands 76 and 78 function with recess 84, since it is smaller in diameter than lands 76 and 78, to facilitate the proper flow of fluid through pressure inlet port 18 to pressure outlet port 20. Once these ports are opened, fluid flows into the PCV 10 through the pressure inlet port 18, through the recess 84 of the pressure spool 50, and out the pressure outlet port 20.

The PCV 10, and particularly the valve body 12, further comprises several ports that function to facilitate fluid flow through the PCV 10 and that communicate with the interior cavity 60. In the embodiment shown, the valve body 12 has formed therein several inlet and outlet ports that are regulated by the positioning of the return and pressure spools 40 and 50. Specifically, the valve body 12 comprises a return inlet port 14 and a return outlet port 16, wherein the return spool 40 is caused to displace to open these ports to allow fluid to flow therethrough and pressure to be purged from the PCV 10, and the system in which it is operating, in those conditions when the feedback pressure exceeds the pilot pressure. The valve body 12 also comprises a pressure inlet port 18 in fluid communication with a source of pressurized fluid (not shown), and a pressure outlet port 20, wherein the pressure spool 50 is caused to displace to open these ports to allow pressurized fluid to flow therethrough and pressure to be input into the PCV 10, and the system in which it is operating, in those conditions when the pilot pressure exceeds the feedback pressure.

The relative position of the return and pressure inlet and outlet ports 14, 16, 18, and 20 along the valve body 12 and with respect to the return and pressure spools 40 and 50 are configured so that when the return inlet and outlet ports 14 and 16 are open, or partially open, the pressure inlet and outlet ports 18 and 20 are closed, or partially closed, and vice versa. Thus, the PCV 10, and more particularly the return and pressure spools 40 and 50 and the return and pressure inlet and outlet ports 14, 16, 18, and 20, are configured so that these conditions are met, thus allowing the PCV to function as intended depending upon the pressures acting within the system. One skilled in the art will recognize other design alternatives, other than the specific ones illustrated and described herein, for satisfying these conditions.

In the embodiment shown in FIG. 1, the return inlet and outlet ports 14 and 16 are shown closed by the return spool 40 as positioned within the valve body 12. Pressure inlet and outlet ports 18 and 20 are also shown closed by the pressure spool 50 as positioned within the valve body 12. This condition or operating configuration represents equivalent feedback and pilot pressures, wherein the system is balanced and in a state of equilibrium. In other words, the PCV 10 is static as no pressure differential exists within the system to displace either of the return or pressure spools 40 and 50. Indeed, pressure is neither being input into the system through pressure ports 18 and 20, nor being purged from the system through the return ports 14 and 16 as the system is balanced between the equivalent pilot and feedback pressures. Thus, any loads operable with an actuator controlled by the PCV will also be static.

The return inlet port 14 fluidly communicates with recess 82 in return spool 40 and a load actuator, such as a hydraulic actuator (not shown). Acting within the load actuator is a load pressure that is induced or applied by a load, minus the friction or other losses internal to the actuator mechanism itself. The load pressure directly influences and dictates the feedback pressure, and in some cases can equal the feedback pressure. In contrast, the return outlet port 16 fluidly communicates with the recess 82 in return spool 40 and a primary return reservoir (also not shown). The fluid communication between these various return ports is controlled by return spool 40, as is discussed in greater detail below. It will be appreciated, however, that when the feedback pressure exceeds the pilot pressure, the return spool 40 is caused to displace to open the return inlet and outlet ports 14 and 16, thus allowing fluid to flow through the return inlet port 14, into recess 82 in return spool 40, and subsequently through the return outlet port 16 toward the primary return reservoir to purge pressure from the system. Once a state of equilibrium is reached, the return spool 40 will displace to close the return ports 14 and 16.

One of the unique aspects of the dual independent spool pressure control valve is that the pilot pressure in the system may be dropped and maintained at a level sufficient to open the return spool 40 and the return inlet and outlet ports 14 and 16, as well as to close the return spool 50 over the pressure inlet and outlet ports. In this mode, the PCV 10 enters an inactive passivity operating state, and functions to allow fluid to slosh or shunt back and forth between the load actuator (hydraulic actuator) and the return reservoir through the return inlet and outlet ports 14 and 16, such as in response to external forces acting on and affecting the movement of the load. This effectively allows the load to free swing or dangle without requiring any active input to drive the load in either direction. The concept of dangle with the PCV 10 in the slosh mode is discussed in greater detail below.

The pressure inlet port 18 fluidly communicates with the recess 84 in pressure spool 50 and the pressurized fluid source (not shown). In contrast, the pressure outlet port 20 fluidly communicates with recess 84 in pressure spool 50 and the load actuator. The fluid communication between these various ports is controlled by the pressure spool 50, as is discussed in greater detail below. It will be appreciated, however, that when the pilot pressure exceeds the feedback pressure, the pressure spool 50 displaces to open the pressure inlet and outlet ports 18 and 20, thus allowing pressurized fluid to flow through the pressure inlet port 18, into recess 84 in pressure spool 50, and subsequently through the pressure outlet port 20 to supply pressure to the load actuator, which converts the increased pressure to a force that actively drives the load.

The valve body 12 further has formed therein a pilot pressure port 26 configured to receive pressurized fluid having a corresponding pilot or control pressure and direct it into the pilot pressure chamber 28. The pilot pressure port 26 fluidly communicates with a pilot valve (not shown) configured to supply pressurized fluid from a fluid source, such as a pump, to the pilot pressure chamber 28. The pressurized fluid (at pilot pressure) input into the pilot pressure chamber 28 through the pilot pressure port 26 functions to act upon a pilot pressure side 42 of return spool 40 and a pilot pressure side 52 of pressure spool 50 to influence the displacement of the return and pressure spools 40 and 50 away from each other. In addition, the pilot pressure input into the pilot pressure chamber 28 functions to oppose or counteract the feedback pressure that is also acting on the return and pressure spools 40 and 50 through the fluid feedback system. As such, the pilot pressure functions as a control pressure for the PCV 10 and the system. Indeed, the pilot pressure may be selectively increased or decreased or held constant relative to the feedback pressure to control the displacement of the return and pressure spools 40 and 50, and therefore the pressure within the system. Varying or changing the pilot pressure may be done very rapidly, which allows the PCV to act like a dynamically pre-defined fixed pressure regulator.

It will be appreciated that the size of the pilot pressure chamber 28 can vary with the magnitude of the pilot pressure and the resultant displacement position of the return and pressure spools 40 and 50 within the valve body as opposed by the feedback pressure acting through the feedback system. Thus, the varying size of the pilot pressure chamber 28 is a function of the relationship between the pilot pressure and the feedback pressure. It will also be appreciated that a pilot pressure chamber 28 will always exist in the PCV 10 as the return and pressure spools 40 and 50 are prohibited from making contact with each other no matter the magnitude of the feedback pressure. Indeed, the return and pressure spools 40 and 50 are limited in the distance they are allowed to displace as a result of the limits imposed by the ends of the valve body 12, as well as various means or limiting means strategically placed within the interior cavity 60 of the valve body.

The limiting means are intended to control the displacement distance each of the return and pressure spools 40 and 50 are allowed to travel within the valve body 12. More specifically, the limiting means function to establish a pre-determined operating position for each of the spools during the various operating states or modes of the PCV 10. One exemplary form of limiting means is a plurality of spool stops strategically positioned within the interior cavity 60 of the valve body 12 to prevent unwanted displacement of the spools within the valve body 12. FIG. 1 illustrates these as spool stops 34, 44, 54 and 58. Return and pressure spools 40 and 50 are unable to come into contact with one another due to spools stops 34 and 54, wherein spool stop 34 restricts the movement of the return spool 40 so that it can never close the pilot port 26, and spool stop 54 restricts the movement of the pressure spool 50 from doing the same. Thus, the pilot pressure chamber 28 is always present and accessible to receive fluid from the pilot pressure source through the pilot pressure port 26.

Return spool feedback port 22, formed in a first end of the valve body 12, facilitates the fluid communication of the load actuator (not shown), which may comprise a load actuator such as a hydraulic actuator, with the return spool feedback chamber 62 and the feedback pressure side 46 of return spool 40 functioning as one boundary for the feedback chamber 62. Thus, fluid from the load actuator can flow through the return spool feedback port 22 and into the feedback chamber 62, thereby communicating a feedback pressure to the feedback pressure side 46 of the return spool 40. The feedback chamber 62 comprises a pre-determined diameter or cross-sectional area, which converts the feedback pressure into a feedback force to be exerted on the return spool 40.

It will be appreciated that when the feedback pressure in the return spool feedback chamber 62 is greater than the pilot pressure in the pilot pressure chamber 28, the return spool 40 will displace towards the center of the pilot pressure chamber 28 until it contacts the spool stop 34, thus opening the return inlet and outlet ports 14 and 16 to release and lower the actuator pressure. The return spool 40 stays in this position until the feedback pressure and the pilot pressure equalize. Conversely, when the feedback pressure in the feedback chamber 62 is less than the pilot pressure in the pilot pressure chamber 28, the return spool 40 will displace towards the end of the valve body 12 away from the pilot pressure chamber 28 until it contacts the spool stop 44. In this position, the return inlet and outlet ports 14 and 16 are closed allowing the system pressure to increase. The return spool 40 maintains this position until the pressure in the feedback chamber 62 again exceeds the pilot pressure in the pilot pressure chamber 28.

Similarly, pressure spool feedback port 24, formed in a second end of the valve body 12, facilitates the fluid communication of the load actuator (not shown) with the pressure spool feedback chamber 68 and the feedback pressure side 56 of the pressure spool 50 functioning as one boundary for the feedback chamber 68. Thus, fluid from the load actuator can flow through the pressure spool feedback port 24 and into the feedback chamber 68, thereby communicating a feedback pressure to the feedback pressure side 56 of the pressure spool 50. The feedback chamber 68 comprises a pre-determined diameter or cross-sectional area, which converts the pressure into a feedback force to be exerted on the pressure spool 50.

It will be appreciated that when the feedback pressure in the pressure spool feedback chamber 68 is greater than the pilot pressure in the pilot pressure chamber 28, the pressure spool 50 will displace towards the center of the pilot pressure chamber 28 until it contacts the spool stop 54, thus closing the pressure inlet and outlet ports 18 and 20. The pressure spool 50 maintains this position until the feedback pressure and the pilot pressure equalize. Conversely, when the feedback pressure in the feedback chamber 68 is less than the pilot pressure in the pilot pressure chamber 28, the pressure spool 50 will displace towards the end of the valve body 12 away from the pilot pressure chamber 28, thus opening the pressure inlet and outlet ports 18 and 20 to increase the system pressure. The pressure spool 50 maintains this position until the pressure in the feedback chamber 68 again exceeds the pilot pressure in the pilot pressure chamber 28, at which time the pressure inlet and outlet ports 18 and 20 are closed.

As discussed, limiting means, namely, spool stops 34, 44, 54 and 58, respectively, are configured to limit the movement of return and pressure spools 40 and 50 within the interior cavity 60 of the valve body 12. More specifically, the limiting means are configured to ensure the proper displacement and alignment of the return and pressure spools 40 and 50 with respect to the return and pressure inlet and outlet ports 14, 16, 18, and 20, as well as the pilot pressure port 26. As noted above, spool stops 34 and 54 restrict the movement of return and pressure spools 40 and 50 towards each other. Specifically, spool stop 34 is positioned such that return spool 40 cannot close pilot pressure port 26. Spool stop 34 also prevents fluid communication between the return inlet and outlet ports 14 and 16 and the return spool feedback port 22.

Spool stop 44 restricts the displacement of the return spool 40 towards the end of the valve body 12, as shown. Specifically, spool stop 44 is positioned such that the return inlet and outlet ports 14 and 16 are closed when the return spool 40 contacts the spool stop 44. It will also be appreciated that the position of spool stop 44 also prevents fluid communication between the return inlet and outlet ports 14 and 16 and the pilot pressure chamber 28.

Spool stop 54 restricts the movement of the pressure spool 50 towards the return spool 40 and the pilot chamber 28. Specifically, spool stop 54 is positioned such that the pressure inlet and outlet ports 18 and 20 are closed when the pressure spool 50 contacts the spool stop 54. Spool stop 54 prevents fluid communication of the pressure inlet and outlet ports 18 and 20 with the pressure spool feedback port 24.

Spool stop 58 restricts the displacement of the pressure spool 50 towards the end of the valve body 12, as shown. Specifically, spool stop 58 is positioned such that the pressure inlet and outlet ports 18 and 20 are closed when the pressure spool 50 contacts the spool stop 58. It will also be appreciated that the position of spool stop 58 also prevents fluid communication between the pressure inlet and outlet ports 18 and 20 and the pilot pressure chamber 28.

As stated, the PCV 10 comprises dual, independent spools, namely return spool 40 and pressure spool 50, that are preferably freely situated or supported within the interior cavity 60 of the valve body 12. By freely supported it is meant that the spools are not physically coupled to each other or any other structure or device, such as mechanical actuating or supporting means. In other words, the spools float within the interior of the valve body and are constrained in their movement or displacement only by the pressures acting upon them and any limiting means located in the valve body 12. In one aspect, the return and pressure spools 40 and 50 are low mass spools. However, the mass of the spools may vary depending upon the application.

Return and pressure spools 40 and 50 are intended to operate within the valve body 12 independent of one another. The term "independent" or the phrase "independently controlled and operated," as used herein, is intended to mean that the two spools are operated or controlled individually or separately and that they are free from interconnection with or interdependence upon one another. This also means that the return and pressure spools 40 and 50 displace or are caused to displace in response to the intrinsic pressure parameters acting within the system at any given time and not by any mechanically or electrically controlled actuation device or system. More specifically, the PCV is intended to regulate pressure within the system in which it is contained in accordance with the pressure feedback system intrinsic to the PCV, wherein the return and pressure spools are caused to displace in accordance with a pressure differential occurring or acting within the system in an attempt to dissipate the pressure differential and to equalize the pilot pressure and the feedback pressure. In the embodiment of FIG. 1, a pressure differential exists when the feedback pressure acting on the outside faces of the return and pressure spools differs from the pilot pressure concurrently acting on the inside faces of the return and pressure spools. As these two pressures concurrently acting on opposite sides of the return and pressure spools differ, and depending upon the dominant pressure, the return and pressure spools will displace to open and close the appropriate ports that would facilitate or cut off the fluid flow needed to balance the overall system pressure or that would attempt to balance the load pressure in the load actuator and the pilot pressure.

In the PCV 10, a pressure differential is created when the feedback pressure acting on the feedback pressure sides of the return and pressure spools 40 and 50 comprises a different magnitude than the pressure acting on the pilot pressure sides of the return and pressure spools 40 and 50. This pressure differential may be in favor of the feedback pressure or the pilot pressure. Either way, the return and pressure spools 40 and 50 are designed to displace in response to the pressure differential in an attempt to restore the pilot pressure and the feedback pressure to a state of equilibrium. However, the pilot pressure, since it is specifically and selectively controlled, will be capable of inducing a pre-determined pressure differential for a pre-determined duration of time. Thus, if the pressure in the system needs to be increased, the pilot pressure is selectively manipulated to exceed the feedback pressure, thus causing the pressure spool 50 to displace to open pressure inlet and outlet ports 18 and 20 and to let pressurized fluid from the pressure source into the system. Likewise, if the pressure in the system needs to be reduced, the pilot pressure can be selectively manipulated to be less than the feedback pressure, thus causing the return spool 40 to displace to open return inlet and outlet ports 14 and 16 and to purge pressure from the system. Although obvious, it is noted that a pressure differential may be induced in the system by manipulation of the pilot pressure or the load or both of these. Either way, the resulting displacement of spools functions to open and close the appropriate inlet and outlet ports to regulate the pressure within the system.

In accordance with the immediate discussion, one of the unique features of the dual independent spool pressure control valve is its intrinsic feedback system. Unlike prior related systems that focus on and function to control fluid flow, this intrinsic feedback system functions to allow the PCV to regulate and control the pressures within a servo or servo-type system automatically, in response to induced conditions, or in a manipulative manner, all without requiring external control means. The intrinsic feedback system is a function of the fluid communication between the various components of the PCV and the pilot and feedback pressures. More particularly, the intrinsic feedback system is a function of the communication between the pilot and feedback pressures acting on opposing sides of the independent return and pressure spools, wherein the feedback and pilot pressures oppose one another, and wherein the feedback pressure is a function of the load pressure. The independent return and pressure spools, which may be considered floating spools within the valve body, are configured to act in concert with one another to systematically displace, in accordance with an induced pressure differential, to open the appropriate ports to either increase or decrease overall system pressure. Owing to the various limiting means strategically placed within the system, as well as the relative positioning of the return and pressure inlet and outlet ports, the independent return and pressure spools are configured to displace accordingly to restore the servo system to as close a state of equilibrium as possible, limited only by system constraints and/or selective and controlled operating conditions. Various examples of the dual independent spool pressure control valve intrinsic feedback system are illustrated in the figures and described below with respect to the various operating states of the PCV.

Return and pressure spools 40 and 50 will move to specific positions in response to the pilot pressure, which is controlled according to whether it is desired that a pressure within the load actuator be increased, whether the load actuator is to be allowed to relax, or whether the load actuator will be required to hold a sustained load.

Finally, first and second feedback ports 22 and 24 are in fluid communication with first and second feedback lines 192 and 196, respectively, wherein the first and second feedback lines 192 and 196 are configured to receive fluid from or transmit fluid to main line 200. Main fluid line 200 fluidly connects to the load actuator (not shown) through a load feed line 210.

Thus, it will be appreciated that when the PCV 10 is in a state of equilibrium with the pilot pressure equivalent to the feedback pressure, both the return spool 40 and the pressure spool 50 are positioned to close the return and pressure inlet and outlet ports 14, 16, 18, and 20 along the valve body 12. In situations where the pilot pressure exceeds the feedback pressure, the pressure spool is caused to displace to open pressure inlet port 18 and pressure outlet port 20, allowing fluid to flow from the pressure source, through pressure spool recess 84 and to the load feed line 210. And when the pilot pressure drops below the feedback pressure, the return spool is caused to displace to open return inlet port 14 and return outlet port 16, allowing fluid to flow from the load feed line 210, through return spool recess 82 and to the primary return reservoir.

Further details and operating states of the PCV illustrated in FIG. 1 are shown and described in U.S. Patent Nos. 7,284,471 to Jacobsen et al.; 7,308,848 to Jacobsen et al.; and 7,779,863 to Jacobsen et al., each of which are incorporated by reference herein in their entirety.

While FIG. 1 illustrates one exemplary embodiment of a PCV, it will be appreciated that other embodiments are contemplated herein. Indeed, the PCV shown in FIG. 1 may be modified to comprise return and pressure spools 40 and 50 of different configurations or sizes. Naturally, however, the valve body 12 would have to comprise corresponding diameters differences to accommodate the different sized spools. Therefore, in other embodiments, it is contemplated that the valve body 12, and the independent spools disposed therein, may comprise uniform or non-uniform diameters, as well as different geometric cross-sectional shapes other than circular. Additionally, ports 14, 16, 18, 20, 22, 24 and 26 in valve body 12 can vary in size, and various size and shape combinations are anticipated in order to obtain particular pressure-force-area relationships necessary for a specific or given application.

Figure 2:
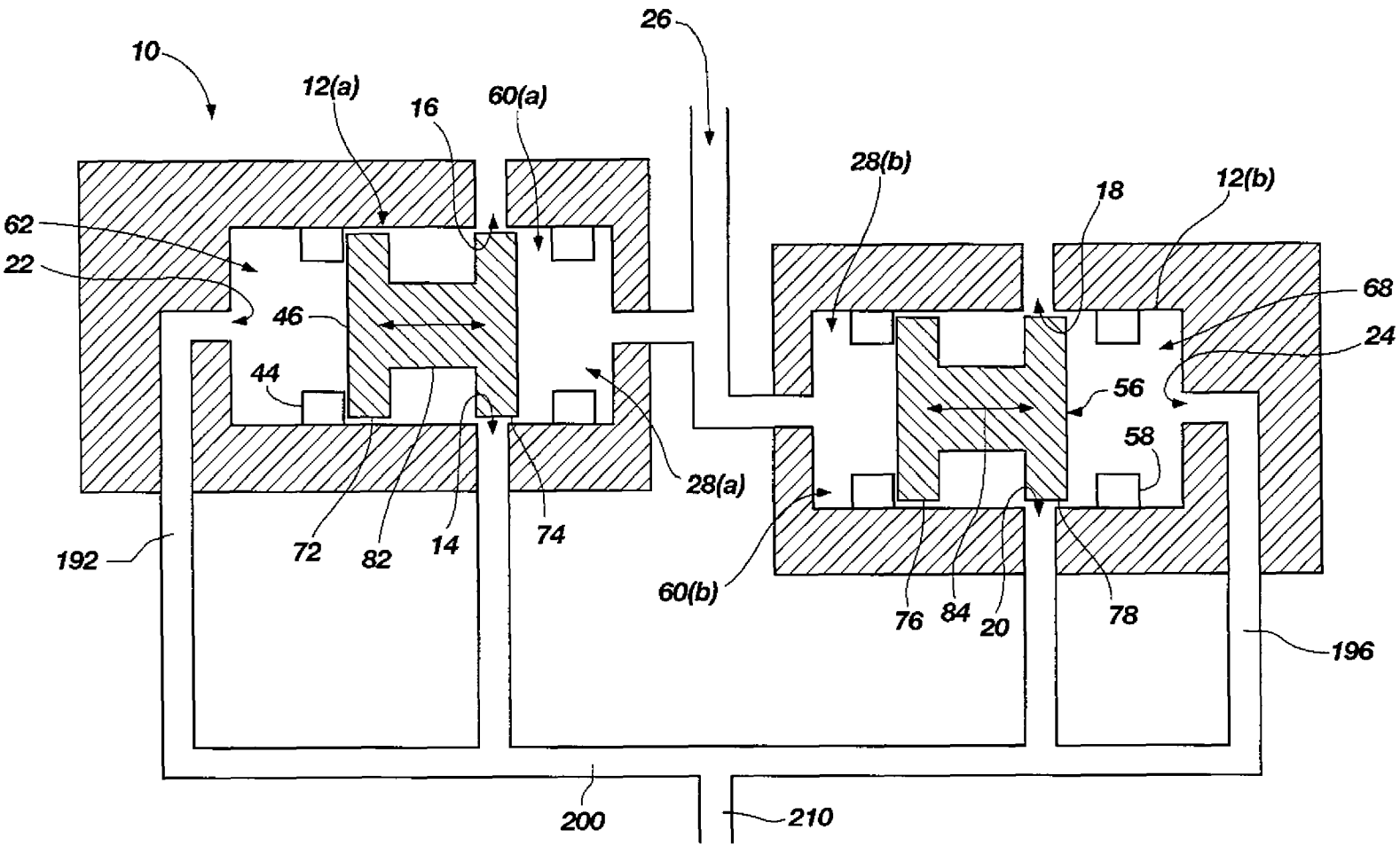
FIG. 2 illustrates a generalized cut-away view, taken along a longitudinal cross-section, of a dual independent spool pressure control valve according to another exemplary embodiment.

FIG. 2. illustrates another exemplary embodiment of the dual independent spool pressure control valve, wherein the PCV 10 comprises a return valve body 12-*a* separate from a pressure valve body 12*b*. Return valve body 12-*a* comprises an interior cavity 60-*a*, which is further divided into a return spool pilot pressure chamber 28-*a* and a return spool feedback chamber 62 by the return spool 40 of FIG. 1. Likewise, pressure valve body 12-*b* comprises an interior cavity 60-*b*, which is further divided into a pressure spool pilot pressure chamber 28-*b* and a pilot spool feedback chamber 68 by the pressure spool 50 of FIG. 1. Both the return spool pilot pressure chamber 28-*a* and the pressure spool pilot pressure chamber 28-*b* are in fluid communication with pilot pressure port 26. Other than the difference in configuration, wherein the chambers of the return valve and the pressure valve are no longer coaxially connected or aligned, the embodiment of FIG. 2 functions in substantially the same manner as that shown in of FIG. 1, which description is incorporated here, where applicable.

Antagonistic Fluid Control Systems

The fluid control system further comprises various embodiments of an antagonistic fluid control system that utilizes one or more forms of the pressure control valves discussed above to control and facilitate the movement or displacement of a load, typically via one or more actuators, wherein the PCVs operating together comprise several operating or valving states. These concepts are discussed and set forth in U.S. application Ser. No. 12/074,260, filed Feb. 28, 2008, and entitled, "Antagonistic Fluid Control System for Active and Passive Actuator Operation" (which claims the benefit of U.S. Provisional Application No. 60/904,245, filed Feb. 28, 2007), which is incorporated by reference in its entirety herein.

A first valving or operating state of the PCVs comprises an active valving state configured to actively control the movement of the load, or in other words drive the load. A second valving or operating state comprises an inactive actuation state, wherein either the return and pressure ports of one PCV are closed, or only the return ports of one PCV are opened, to allow the other PCV to operate in an active valving state. A third valving or operating state comprises a truly passive valving state, namely an inactive passivity valving state, wherein the PCVs are operated in a slosh mode, as discussed above, configured to allow the load to move or dangle. In this third passive valving state, or slosh mode, the return ports of the two PCVs are opened to allow fluid, and preferably local fluid, to shunt back and forth within the system in response to a non-actuated load movement. Thus, in the state of inactive passivity, the load is allowed to move or displace without requiring any active input from the system, such as the use of fluid from the high-pressure supply reservoir. This unique feature has several advantages over prior related servo systems, such as an increase in overall efficiency, and the ability to provide movements that are more natural or that more closely resemble those found in nature, such as the natural movement of a leg or arm.

In one aspect, an antagonistic fluid control system may be realized by way of antagonistic pressure control valves providing actuation to a single actuator. In another aspect, an antagonistic fluid control system may be realized by way of multiple pressure control valves (PCVs) operable, respectively, with the one or more pairs of antagonistic load actuators.

Figure 3:
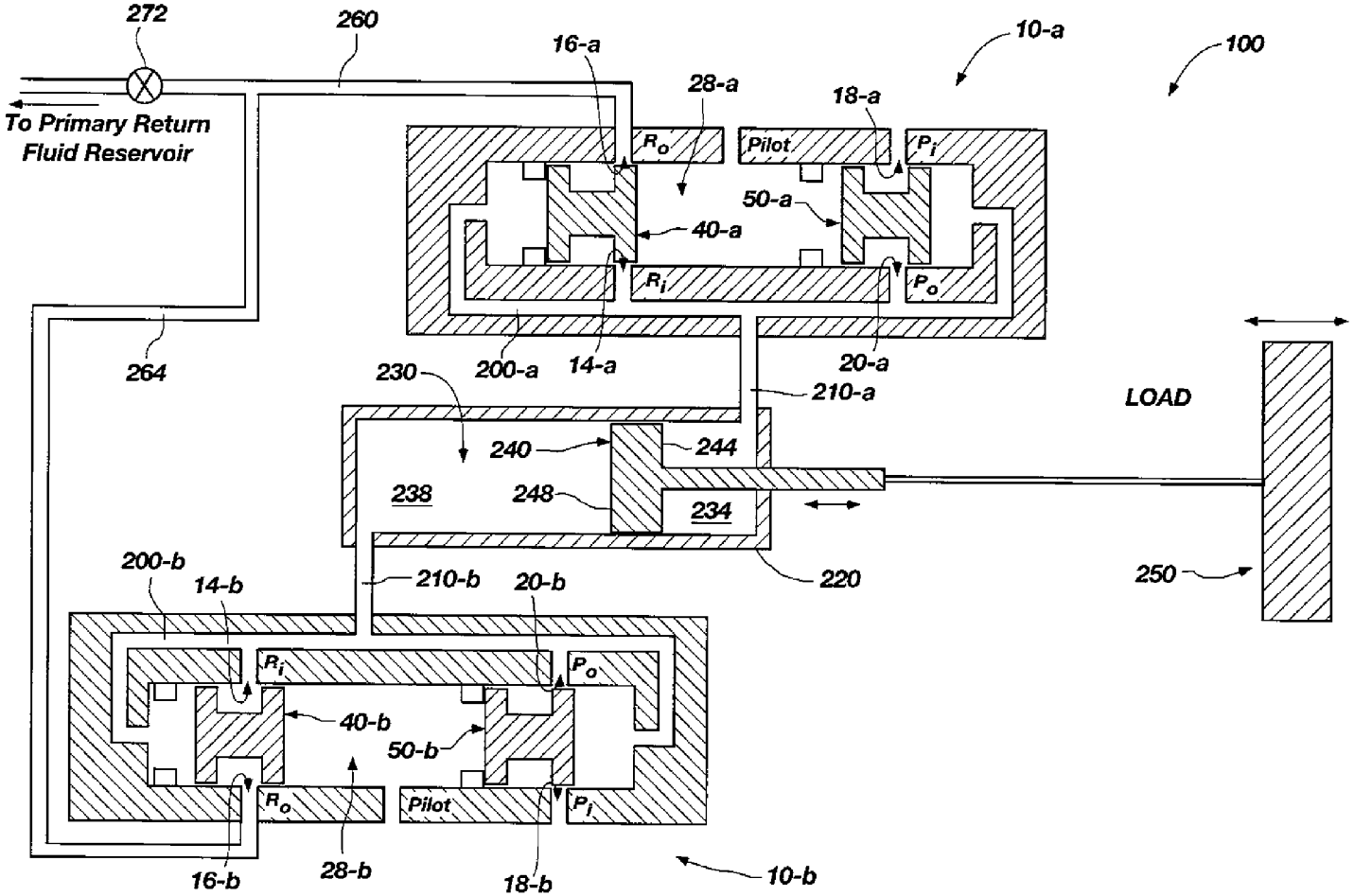
FIG. 3 illustrates a generalized diagram of a fluid control system, wherein two like, antagonistic dual independent spool pressure control valves, such as the pressure control valve of FIG. 1, are used in combination with one another to actuate a single dual-acting actuator, and wherein each of the pressure control valves comprise an intrinsic fluid feedback system.

FIG. 3 illustrates one exemplary embodiment of an antagonistic fluid control system 100. In this embodiment, two dual independent spool PCVs are used in combination with one another to control or provide control pressure to a single actuator 220. The PCVs function together to control pressure within the system 100. Specifically, PCV 10-*a* is configured to control the fluid and pressure used to drive or displace the actuator piston 240, and consequently the load, in one direction, while PCV 10-*b* is configured to control the fluid and pressure used drive or displace the actuator piston 240, and consequently the load, in the opposite direction. Each of the PCVs 10-*a* and 10-*b* are similar in structure as those shown in FIG. 1 and described above.

In operation, PCVs 10-*a* and 10-*b* are configured to operate in either an active valving state, an inactive valving state, or an inactive passive valving state (inactive passivity). The dual PCVs are each individually and selectively controlled to enter any one of these operating states at any given or pre-determined time and for any given or pre-determined duration. In the embodiment shown, PCV 10-*a* is configured to actuate or displace the actuator piston 240, and to drive the load 250, in one direction. In an active valving state, the pilot pressure in the pilot chamber 28-*a* of the PCV 10-*a* is manipulated so that the pressure spool 50-*a* displaces to open the pressure inlet and outlet ports 18-*a* and 20-*a*, while the return inlet and outlet ports 14-*a* and 16-*a* are caused to close. The return spool 40-*a* does not displace as the pilot pressure is kept above that of the pressurized fluid downstream of the PCV in the load feed line 210-*a*.

In an open position, the pressure spool 50-*a* functions to allow pressurized fluid (i.e., fluid having a higher pressure than the load pressure acting within the load chamber 234) from a pressure source (not shown) to enter into the system 100. Pressurized fluid enters pressure inlet port 18-*a*, passes through pressure outlet port 20-*a*, into main fluid line 200-*a*, then into load feed line 210-*a*, and finally into the chamber 234 of the actuator cylinder 230. As the pressurized fluid enters into the chamber 234, it acts upon a first side 244 of the actuator piston 240. Since the force exerted by the pressurized fluid entering chamber 234 is greater than the combined forces produced by the pressure existing within opposing chamber 238 and the external forces acting on the load, such friction or gravity, the actuator piston 240 is caused to displace, thus driving or displacing the coupled load 250 accordingly. According to one embodiment where the fluid control system 100 is controlled based on position, once the load is driven to the point desired, the pilot pressure is again manipulated to displace the pressure spool 50-*a* and close the pressure inlet and outlet ports 18-*a* and 20-*a*.

With the PCV 10-*a* in its active valving state to drive the load 250, the PCV 10-*b* may be kept in an inactive valving state, wherein the return inlet and outlet ports 14-*b* and 16-*b* are caused to open to release fluid from the system 100 to the primary return reservoir (not shown).

Likewise, PCV 10-*b* is configured to actuate or displace the actuator piston 240, and to drive the load 250, in a direction opposite that caused by the active valving state of the PCV 10-*a*. In an active valving state, the pilot pressure in the pilot chamber 28-*b* of the PCV 10-*b* is manipulated so that the pressure spool 50-*b* displaces to open the pressure inlet and outlet ports 18-*b* and 20-*b*, while the return inlet and outlet ports 14-*b* and 16-*b* are caused to close. The return spool 40-*b* does not displace as the pilot pressure is kept above that of the pressurized fluid downstream of the PCV in the load feed line 210-*b*.

In an open position, the pressure spool 50-*b* functions to allow pressurized fluid (i.e., fluid having a higher pressure than the load pressure acting within the load chamber 238) from a pressure source (not shown) to enter into the system 100. Pressurized fluid enters pressure inlet port 18-*b*, passes through pressure outlet port 20-*b*, into main fluid line 200-*b*, then into load feed line 210-*b*, and finally into the chamber 238 of the actuator cylinder 230. As the pressurized fluid enters into the chamber 238, it acts upon a second side 248 of the actuator piston 240. Since the pressure of the fluid entering the chamber 238 is greater than the combined forces produced by the pressure existing within opposing chamber 234 and the external forces acting on the load, such friction or gravity, the actuator piston 240 is caused to displace, thus driving or displacing the coupled load 250 accordingly. According to one embodiment where the fluid control system 100 is controlled based on position, once the load is driven to the point desired, the pilot pressure is again manipulated to displace the pressure spool 50-*b* and close the pressure inlet and outlet ports 18-*b* and 20-*b*.

With the PCV 10-*b* in its active valving state to drive the load 250, the PCV 10-*a* is caused to enter an inactive valving state, wherein the return inlet and outlet ports 14-*a* and 16-*a* are caused to open to release fluid from the system 100 to the primary return reservoir (not shown). The function of PCV 10-*b* is similar to that of PCV 10-*a*.

As can be seen, by selectively and alternately actuating the active valving states of both of the PCVs 10-*a* and 10-*b*, the actuator piston 240, and consequently the load 250, can be displaced or driven back and forth in a bi-directional manner as desired, wherein each PCV is configured to provide opposing unidirectional displacement of the actuator piston 240.

Perhaps the most advantageous feature of the present invention valving system and corresponding fluid control system is the ability of the load to free swing or dangle under either an externally applied load, or as a result of intrinsic forces, such as momentum created during the active actuation of the load by one or both PCVs. The ability to free swing or dangle is a result of the unique configuration and design of the PCVs used to provide the pressure control to the fluid control system. Each of the PCVs shown in FIG. 2 are capable of entering an inactive passive state, or a slosh mode as defined above. In order to endow the load with free swing or dangling capabilities, each of the PCVs 10-*a* and 10-*b* are caused to enter the passive actuation state, or slosh mode, simultaneously.

To enter the inactive passive state, the pilot or control pressures in the each of the respective pilot chambers 28-*a* and 28-*b* of the PCVs 10-*a* and 10-*b* are individually manipulated and maintained to be below the load pressure or feedback pressure acting on the return and pressure spools 40-*a*, 40-*b*, 50-*a* and 50-*b* as exerted by the load actuator 220. As this pilot pressure is below the load or feedback pressure acting on the spools 40 and 50, the return spools 40-*a* and 40-*b* are caused to displace to open return inlet and outlet ports 14-*a*, 16-*a*, 14-*b*, and 16-*b*, respectively. Pressure spools 50-*a* and 50-*b* remain closed due to the limiting means located within each of the PCVs 10-*a* and 10-*b*.

Also part of the configuration of the PCVs 10-*a* and 10-*b* is the fluid connection of the return outlet ports 16-*a* and 16-*b*. As shown, return outlet port 16-*a* of the PCV 10-*a* is fluidly connected to the return outlet port 16-*b* of the PCV 10-*b* via the return lines 260 and 264. Return line 260 is fluidly connected to the return outlet port 16-*a* and extends therefrom to fluidly connect to return line 264, as well as the primary return reservoir (not shown). Similarly, return line 264 is fluidly connected to the return outlet port 16-*b* and extends therefrom to fluidly connect to the return line 260, as well as the primary return reservoir. A flow control valve 272 is situated downstream from the intersection of the return fluid lines 260 and 264 and is configured to selectively regulate return fluid flow from the system 100 to the primary return reservoir.

By fluidly connecting the return outlet ports of the two PCVs, and by controlling the pilot pressures to be below the load or feedback pressures, thus displacing the return spools 40-*a* and 40-*b* and opening the return inlet and outlet ports 14-*a*, 16-*a*, 14-*b*, and 16-*b*, the PCVs 10-*a* and 10-*b* are caused to enter the inactive passive valving state, or slosh mode. In this state, fluid is able to shunt back and forth within the system 100, and particularly between the load actuator 220, the PCV 10-*a*, and the PCV 10-*b*, as the actuator piston 240 displaces back and forth in response to a non-actuated force (i.e. the actuator can easily be backdriven). For example, in the slosh mode, if an external force pulls on the load 250 causing it to displace, the actuator piston 240 coupled to the load also displaces within the actuator load cylinder 230. Displacement of the load 250 and the actuator piston 240 within the load cylinder 230 in this direction functions to displace the fluid within the load cylinder chamber 234 in the direction of the displacement of the actuator piston 240. The displaced fluid, which has low compressibility, flows out of the load feed line 210-*a* and into the main fluid line 200-*a*. Once in the main fluid line 200-*a*, the displaced fluid is unable to flow through the pressure outlet port 20-*a* since the pressure spool 50-*a* is in the closed position. Thus, fluid is forced to flow into the PCV 10-*a* through the return inlet port 14-*a*, past the opened return spool 40-*a*, out the PCV 10-*a* through the return outlet port 16-*a*, and into the return fluid line 260.

With the flow control valve 272 closed, thus cutting off access to the primary return reservoir, the fluid is further forced to flow out of the return fluid line 260 into the return fluid line 264. From here, the fluid flows into the PCV 10-*b* through the return outlet port 16-*b*, past the opened return spool 40-*b*, and out of the PCV 10-*b* through the return inlet port 14-*b*. From the return inlet port 14-*b*, the fluid flows into the main fluid line 200-*b*. Since the pressure outlet port 20-*b* is closed due to the closed positioning of the pressure spool 50-*b*, fluid is unable to enter back into the PCV 10-*b* through the pressure outlet port 20-*b*. Instead, the fluid is forced to enter the load feed line 210-*b*, and subsequently the load cylinder chamber 238 on the opposite side of the actuator piston 240.

It is understood that actuation of the load 250 in the opposite direction will cause the fluid in the system 100 to flow in an opposite direction and back through the path just described.

In an alternative to closing the control valve 272, the primary return reservoir can be slightly pressurized. Maintaining the primary return reservoir at a low positive pressure and then dropping the pilot pressure below the primary return reservoir pressure creates the same effect as closing control valve 272; instead of the hydraulic fluid in PCV 10-*a* flowing back into the primary return reservoir, it will flow through the return lines to PCV 10-*b*, and from there into the chamber on the opposite side of the actuator piston 240.

The back and forth displacement of the fluid in the system 100 when the PCVs 10-*a* and 10-*b* are in the inactive passive valving state or slosh mode is described herein as the shunting of the fluid within the system and facilitates the free swing or dangle of the load 250. As can be seen, the load 250, and the actuator piston 240 coupled to the load 250, are able to move under the externally applied load without active input from the system. In other words, no active input is needed to facilitate or enable the displacement of the load and the actuator piston in response to the externally applied force. Instead, the load 250, and the actuator piston 240, are allowed to free swing or dangle in direct response to the force applied to the load 250.

A further advantage of the present invention is the ability to position both PCVs 10-*a* and 10-*b* in the inactive passive valving state as the load is being decelerated, or in other words, move the system into slosh mode for efficient braking. Depending upon the circumstances, ending an active actuation of the load may result in a corresponding momentum force induced within the load. This momentum force (if sufficient to further displace the load) may be efficiently reduced by placing the PCVs in the inactive passive valving state, or slosh mode. In this state, the shunting of the fluid between the PCVs and the load actuator results in loses which dissipate the kinetic energy of the load. When braking in slosh mode the PCVs will allow the load to passively displace a distance beyond that provided by the active displacement of the load, but no additional fluid from the high-pressure supply reservoir will be used to retard or arrest the movement of load.

It is noted herein that the inactive passive valving state of the PCVs utilizes, for the most part, local fluid. The phrase "local fluid" is defined herein as that fluid that is contained within the PCVs, the load actuator, and any fluid lines extending therebetween, and that is not part of the primary return reservoir. More specifically, "local fluid" is intended to mean that fluid existing within the fluid control system that is isolated or fluidly disconnected from the primary return reservoir at the time the PCVs are placed in the inactive passive valving states. In the embodiment shown in FIG. 3, the local fluid comprises that fluid which exists within the PCV 10-*a*, the PCV 10-*b*, and the load actuator 220, as well as the lines connecting these (namely load feed lines 210-*a* and 210-*b*, main fluid lines 200-*a* and 200-*b*, and return lines 260 and 264).

As can be seen, the local fluid in the actuation system 100 of FIG. 1 may be fluidly disconnected from the primary return reservoir by the closing of the flow control valve 272. However, in an alternative to closing control valve 272, the primary return reservoir can be slightly pressurized. Maintaining the primary return reservoir at a low pressure and then dropping the pilot pressure below the return reservoir pressure accomplished the same effect as closing control valve 272. With a pressurized primary return reservoir there may be a slight amount of back flow from the reservoir into return lines 260 and 264 when the system is placed in slosh mode by dropping the pilot pressures of both PCVs below that of the primary return reservoir. However, the amount of fluid flow between the return reservoir and the actuator is very small.

Figure 4:
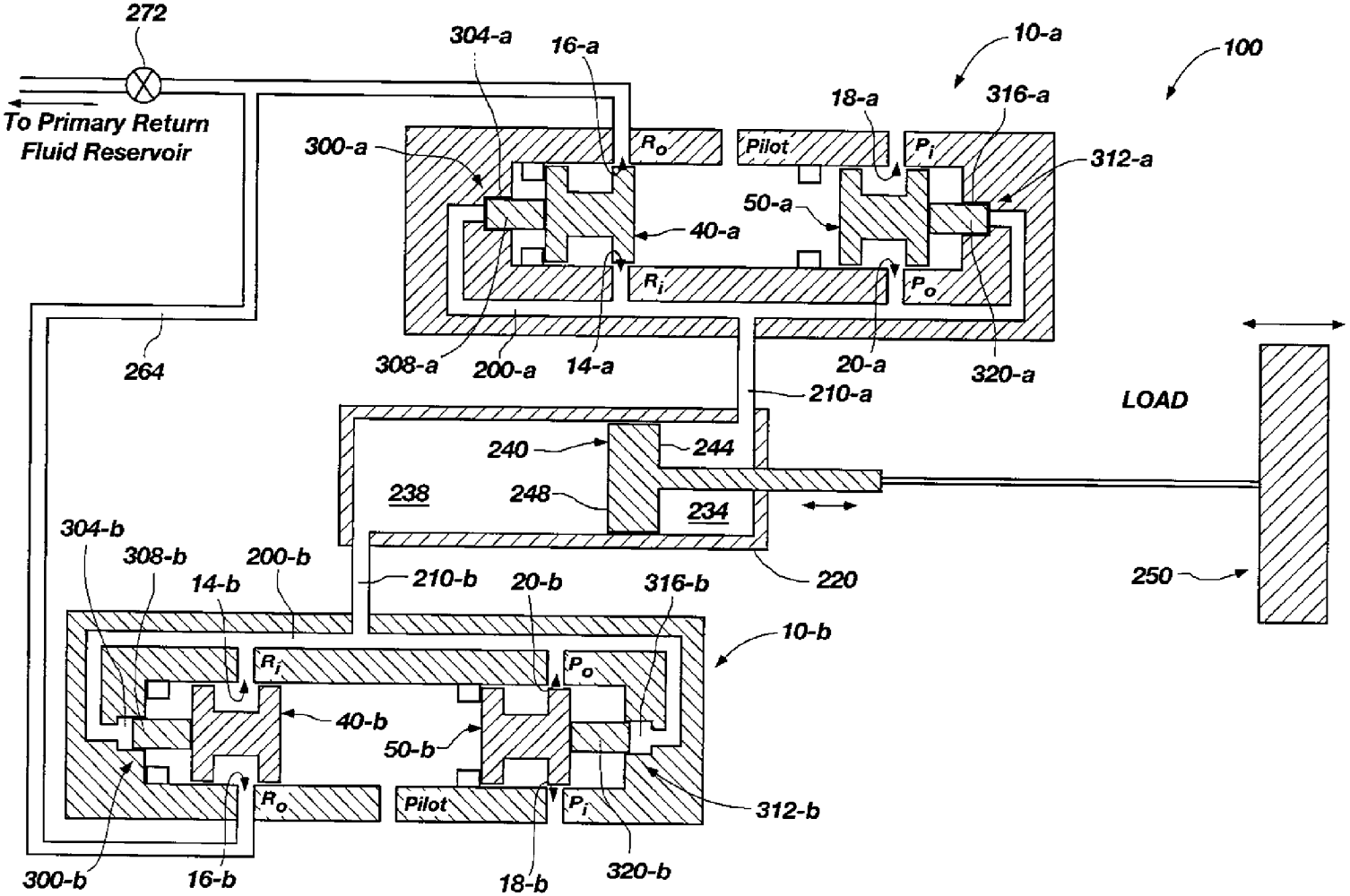
FIG. 4 illustrates a generalized diagram of a fluid control system, wherein two like antagonistic dual independent spool pressure control valves, such as the pressure control valve of FIG. 1, are used in combination with one another to actuate a single dual-acting actuator, and wherein each of the pressure control valves comprise an intrinsic fluid feedback system.

Referring now to FIG. 4, illustrated is an alternative embodiment to the embodiment shown in FIG. 3 and discussed above. FIG. 4 illustrates dual PCVs 10-*a* and 10-*b* that are used in combination with a single actuator 220 to control pressure within the fluid control system 100. Specifically, PCV 10-*a* is configured to control the fluid and pressure used to drive or displace the actuator piston 240, and consequently the load 250, in one direction, while PCV 10-*b* is configured to control the fluid and pressure used drive or displace the actuator piston 240, and consequently the load 250, in the opposite direction. Each of the PCVs 10-*a* and 10-*b* are similar in structure as those shown in FIGS. 1-3 and described above, only the PCVs 10-*a* and 10-*b* illustrated in FIG. 4 comprise an intrinsic mechanical feedback system, such as those described in the patent identified above, and incorporated herein.

As shown, PCV 10-*a* comprises a first intrinsic mechanical feedback system 300-*a*, which consists of a feedback cylinder 304-*a* and a feedback piston 308-*a*. PCV 10-*a* also comprises a second intrinsic mechanical feedback system 312-*a*, which also consists of a feedback cylinder 316-*a* and a feedback piston 320-*a*. Likewise, PCV 10-*b* comprises a first intrinsic mechanical feedback system 300-*b*, which consists of a feedback cylinder 304-*b* and a feedback piston 308-*b*. PCV 10-*b* also comprises a second intrinsic mechanical feedback system 312-*b*, which also consists of a feedback cylinder 316-*b* and a feedback piston 320-*b*. The PCVs 10-*a* and 10-*b* illustrated in FIG. 3 function in a similar manner as the PCVs illustrated in FIG. 2, only the PCVs illustrated in FIG. 3 utilize a mechanical feedback system instead of a fluid feedback system. Thus, the above discussion with respect to FIG. 2 is hereby incorporated, where applicable.

Figure 5:
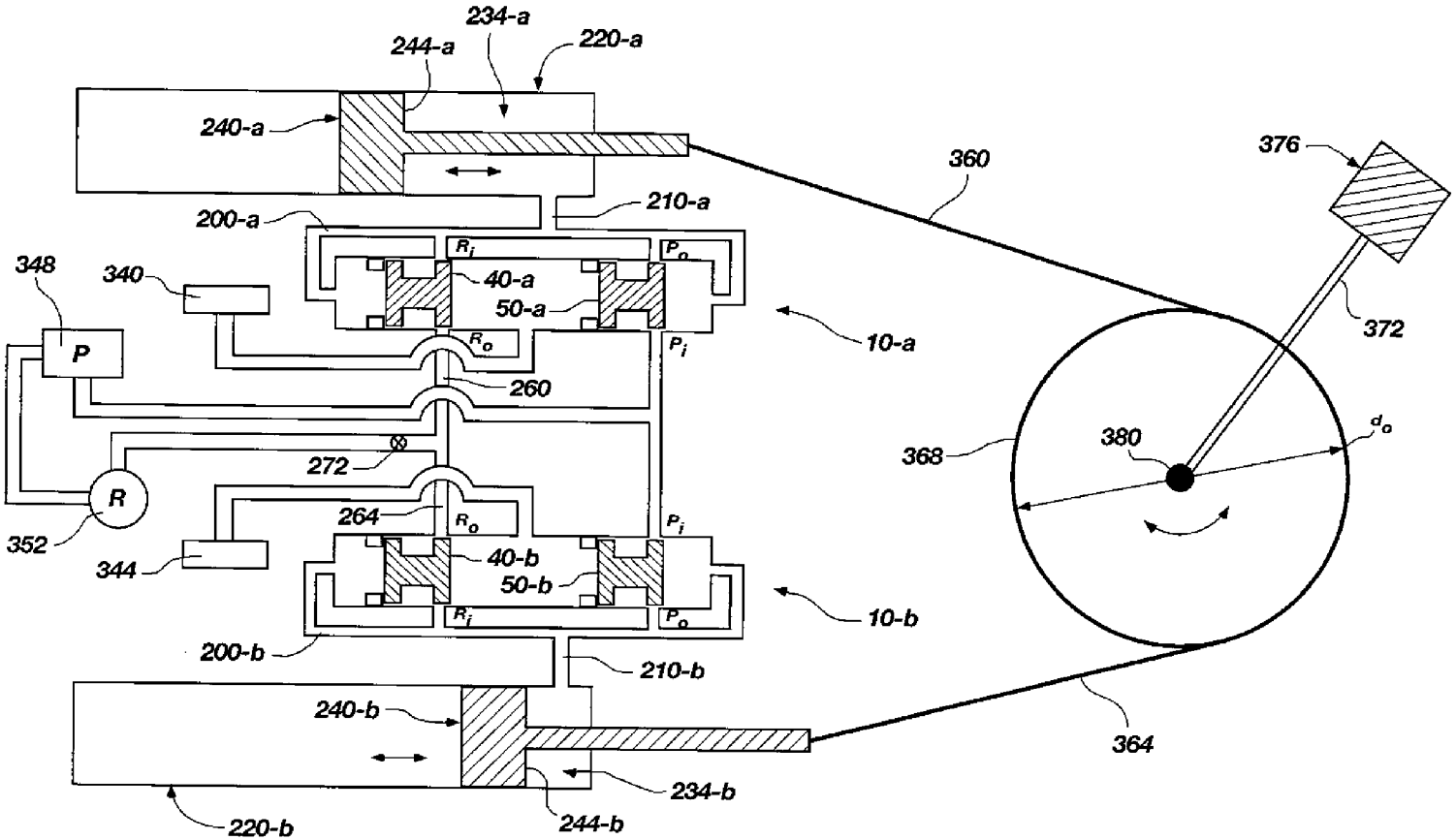
FIG. 5 illustrates a generalized diagram of a fluid control system in accordance with another exemplary embodiment of the present invention, wherein two dual independent spool pressure control valves function to actuate respective, selectively recruitable antagonistic actuators configured to drive a load via a system of opposing tendons supported by a pulley.

FIG. 5 illustrates a fluid control system in accordance with one exemplary embodiment of the present invention, wherein the fluid control system utilizes the pressure control valves discussed above. More specifically, the fluid control system comprises two dual independent spool pressure control valves that function to actuate respective antagonistic tendon actuators configured to drive a load via opposing tendons supported by a pulley. As shown, the fluid control system comprises a first PCV 10-*a* configured in a similar manner as the PCV described above and illustrated in FIG. 1, which description is incorporated herein. The first PCV 10-*a* comprises dual independent spools 40-*a* and 50-*a* that independently displace within the valve body of the PCV in accordance with a pressure differential between a load pressure as exerted by a load 376 through a load actuator 220-*a* and a pilot or control pressure as received from a pilot valve 340.

Likewise, the fluid control system comprises a second PCV 10-*b*, also configured in a manner similar to the PCV described above and illustrated in FIG. 1. The second PCV comprises dual independent spools 40-*b* and 50-*b* that independently displace within the valve body of the PCV in accordance with a pressure differential between a load pressure as exerted by the load 376 through a load actuator 220-*b* and a pilot or control pressure as received from a pilot valve 344.

The first and second PCVs 10-*a* and 10-*b* are fluidly coupled to one another via their return outlet ports and fluid lines 260 and 264, which are also in fluid communication with return reservoir 352. However, as described above, a valve 272 may be included to prevent fluid flow to the return reservoir 352 when the PCVs are operated in slosh mode. Or, as also described above, the return reservoir may be maintained at a low positive pressure. The PCVs are also fluidly coupled to one another via their pressure inlet ports, which are also in fluid communication with pressure source or supply reservoir 348. Of course, as one skilled in the art will recognize, separate supply and return reservoirs may be incorporated, or separate pressure supply lines may be used rather than fluidly coupling PCVs 10-*a* and 10-*b* together via their pressure inlet ports.

The first PCV 10-*a* is configured to operate and control the first load actuator 220-*a*, which comprises a piston 240-*a* disposed within a cylinder. The first load actuator 220-*a*, or more particularly the piston 240-*a*, is tethered to a tendon 360, which is supported by a pulley 368 configured to rotate about a pivot point 380.

The second PCV 10-*b* is configured to operate and control the second load actuator 220-*b*, which also comprises a piston 240-*b* disposed within a cylinder. The second load actuator 220-*b*, or more particularly the piston 240-*b*, is tethered to a second tendon 364, which is also supported by the pulley 368. The tendons 360 and 364 are configured to be in tension between the pistons and the pulley 368. The tendons 360 and 364 may be lengths of a single tendon (e.g., a single cable) wrapped around the pulley 368, or they may be independent tendons (e.g., two separate cables) each coupled to each other and/or the pulley 368 and the respective load actuators. The pulley 368 is further configured to support a load 376, such that upon actuation of the various load actuators, the pulley 368 is caused to rotate to drive the load back and forth.

In operation, namely to drive the load 376 and control its back and forth movements, the various actuators 220-*a* and 220-*b* are actuated. This is done by controlling the pilot pressures within the system as applied to the various load actuators 220-*a* and 220-*b* from the PCVs 10-*a* and 10-*b*, respectively. For example looking at FIG. 5, to drive the load in a counterclockwise direction the pilot valve 340 is caused to increase the pilot or control pressure fed to the pilot chamber of the PCV 10-*a*. Increasing the pilot pressure to be above the load pressure exerted on the piston 240-*a* causes the spool 50-*a* within the PCV 10-*a* to displace to open the pressure port in fluid communication with the pressure source 348. Pressurized hydraulic fluid is then allowed to flow from the PCV 10-*a* into the load actuator 220-*a* through fluid line 210-*a* and into chamber 234-*a*. The increased pressure overcomes the load pressure and causes piston 240-*a* within the cylinder to displace away from the chamber opening. Since the piston 240-*a* is tethered to the tendon 360, the tendon 360 is pulled on as the piston 240-*a* displaces, which rotates the pulley 368 in a counterclockwise direction, thus in turn rotating the load 376 also in a counterclockwise direction, or in other words, driving the load. As the pulley 368 is caused to rotate in a counterclockwise direction, this effectively pulls the tendon 364, which causes the piston 240-*b* within the second load actuator 220-*b* to displace within its cylinder, as the two are tethered together. As such, the fluid within the load actuator 220-*b* is forced out of the chamber through the fluid line 210-*b* and into the second PCV 10-*b* through its return inlet port. Since the fluid in the system is substantially incompressible, this is made possible only by opening the return inlet port in the PCV 10-*b*. Therefore, as the pilot valve 340 is caused to increase the pilot pressure to the first PCV 10-*a*, the pilot valve 344 is simultaneously caused to decrease the pilot pressure to the second PCV 10-*b*. Decreasing the pilot pressure to the second PCV 10-*b* effectively causes the return spool 40-*b* to displace to open the return inlet and outlet ports. Thus, as the pulley 368 is rotated counterclockwise and the piston 240-*b* displaced to compensate, fluid is able to flow from the second load actuator 220-*b*, through the PCV 10-*b*, and back to the return reservoir 352.

To operate the fluid control system to rotate the pulley 368 in the clockwise direction, and therefore to drive the load accordingly, the system is actuated in an inverse manner, namely the pilot pressure in the second PCV 10-*b* is increased while the pilot pressure in the first PCV 10-*a* is decreased.

In slosh mode, the pilot pressures in both the PCVs 10-*a* and 10-*b* are individually lowered and maintained at a sufficiently reduced level to open the return inlet and outlet ports in each PCV 10-*a* and 10-*b*. The return outlet ports of each PCV are in fluid communication with one another. As discussed, in the slosh mode, the load is allowed to freely rotate or dangle in response to external or intrinsic input without active actuation of either load actuator 220-*a* or 220-*b*. The discussion with respect to slosh discussed above is incorporated herein, as applicable. In the slosh mode, the load 376 may rotate back and forth without active actuation as fluid is capable of shunting back and forth between the PCVs 10-*a* and 10-*b*. The fluid shunting back and forth may be caused to be local fluid only by closing the valve 272 in the return line leading to the return reservoir 352.

The fluid control system as configured in FIG. 5 offers additional significant advantages over prior related systems. First, the mechanism provides a larger range of motion compared to that achieved using dual acting linear actuators with mechanical linkages. And second, the actuator can also be operated in a manner that effectively eliminates backlash, as both tendons may be kept under tension (co-contracting) while the load is being moved. Both features, when combined with the capability of placing the control mechanism in slosh mode as described above, provides improved performance in an exemplary operating environment for the exemplary fluid control systems described herein, such as those used to control the movements in an arm or leg of a robot, wherein the arm or leg is capable of providing more natural lifelike movements as a result of the ability to dangle. Exploiting the passive braking capability provided by the pair of PCVs further improves system performance and efficiency.

Recruitment of Actuators for Variable Output

The present invention contemplates a variable output power system that maximizes performance of the fluid control system in terms of the output power, namely the force or torque with respect to velocity or speed, by providing a plurality of pairs of different sized antagonistic actuators operating with pressure control valves, which pairs of actuators may be selectively recruited or activated to optimize the fluid control system in terms of both the actuated force and speed of the load for a given operating condition, which therefore optimizes the amount of pressurized fluid needed, thus greatly improving the efficiency of the system. In other words, the output power is optimized for any given operating condition of the load. For example, in some instances, it may be desirable to provide large amounts of force or torque to the load to enable the load to perform high energy work. In these instances, the system may select from the available pairs of actuators to provide the needed or desired level of force or torque, while simultaneously optimizing the speed of actuation, thereby minimizing the amount of pressurized fluid needed to achieve and supply such force or torque. As such, the speed of the load may be considered in the selection of actuators.

In other instances, it may be desirable to provide high actuation speeds to enable the load to perform in a given way. In these instances, the system may select from the available pairs of actuators to provide the needed or desired speed, while simultaneously optimizing the force that allows such speeds to be achieved, again minimizing the amount of pressurized fluid needed.

Figure 6:
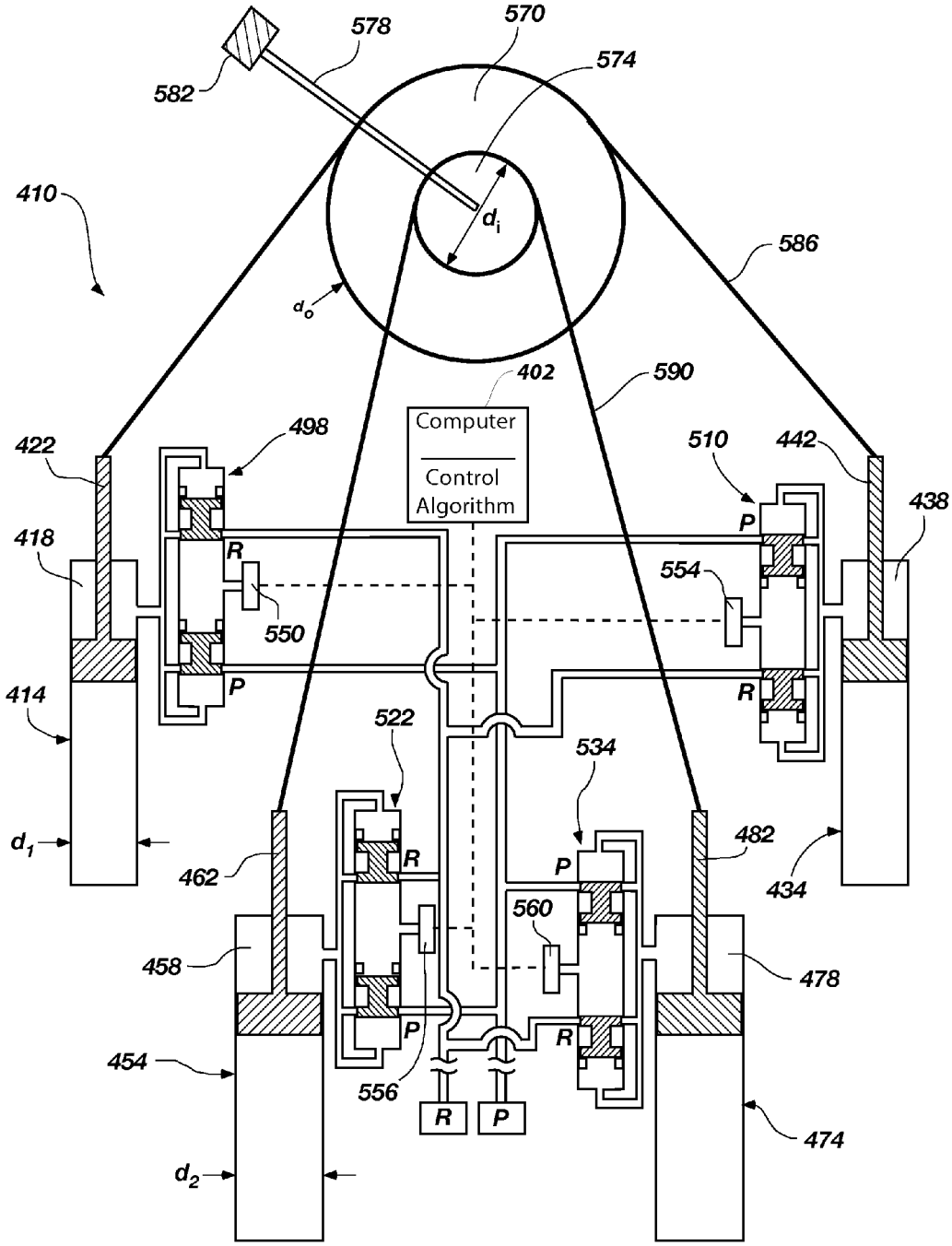
FIG. 6 illustrates a generalized diagram of a fluid control system in accordance with another exemplary embodiment of the present invention, wherein multiple pairs of recruitable parallel, antagonistic actuators are selectively recruited to provide variable output to a load.

With reference to FIG. 6, illustrated is an exemplary fluid control or actuation system in accordance with one exemplary embodiment of the present invention. As shown, the fluid control system 410 comprises a first pair of parallel actuators, namely actuator 414 and actuator 434 situated antagonistically with respect to one another, and a second pair of parallel actuators, namely actuators 454 and 474, also situated antagonistically with respect to one another. The first pair of parallel actuators 414 and 434 are similar in size and configuration, with each comprising a diameter $d_1$. Likewise, the second pair of parallel actuators 454 and 474 are similar in size and configuration, with each comprising a diameter $d_2$. It is specifically noted that parallel actuators 414 and 434 are different in size than parallel actuators 454 and 474, with actuators 414 and 434 being smaller in size. Operable with actuator 414 is PCV 498 and pilot valve 550. Operable with actuator 434 is PCV 510 and pilot valve 554. Operable with actuator 454 is PCV 522 and pilot valve 556. And, operable with actuator 474 is PCV 534 and pilot valve 560. Each of the PCVs 498, 510, 522 and 534 and pilot valves 550, 554, 556 and 560 function in a similar manner as described above to control actuation of their respective actuators. Although the pressure control valves discussed herein may be preferred due to their advantageous valving states, the principles of recruiting different sized parallel actuators within an antagonistic environment may be achieved with other types of valves.

Although the embodiment of FIG. 6 illustrates a separate PCV operable with each different actuator within the system, it is contemplated that at least one or a single PCV may be used to control each pair of antagonistic parallel actuators. In other words, at least one PCV may be configured to be operable with each pair of first and second pairs of parallel actuators.

FIG. 6 also illustrates a dual tendon drive system operable with the first and second pairs of parallel actuators, in which these actuators operate with (e.g., to power) a single load, shown as load 582. As shown, the dual tendon drive system comprises a first outer pulley 570 having a diameter $d_o$, and a second inner pulley having a diameter $d_i$. A first tendon 586 operates with the first pulley 570, with a first end being coupled to a piston 422 operably supported within actuator 414, and a second end being coupled to a piston 442 operably supported within actuator 434. Similarly, a second tendon 590 operates with second pulley 574, with a first end being coupled to a piston 462 operably supported within actuator 454, and a second end being coupled to a piston 482 operably supported within actuator 474. Different sized pulleys may be provided to gain additional mechanical advantage with respect to the recruited actuators. However, it is contemplated that pulleys of the same size may also be used. The pulleys 470 and 474 are shown as being concentric with one another and with each one comprising a uniform radius. However, it is contemplated that the pulleys may comprise a variable radius or eccentric configuration with an off-center mount to also provide additional mechanical advantage to the actuation of the load. Furthermore, the pulleys may be configured to comprise a cam for the same purpose.

In operation, the fluid control system 410 functions to provide variable output to the load through the selective recruitment of one or more pairs of the parallel actuators operable with the tendon drive system and the pressure control valves. By recruiting different sized and/or combinations of pairs of parallel actuators effective gear shifting is made possible to optimize the output to the load 582. This may be accomplished utilizing the various valving states of the PCVs operable with the respective actuators. For example, in a first actuation state, a first pair of parallel actuators 414 and 434 may be recruited by operating PCVs 498 and 510, respectively, operable therewith, and providing pressurized fluid to the PCVs 498 and 510 in an alternating manner so as to cause the pistons 422 and 442 to displace within the actuator housings 418 and 438, respectively, in an alternating manner. The active valving state required of PCVs 498 and 510 may be achieved as explained above, and the system may function in a similar manner as discussed above and shown in FIG. 5. However, unlike the system in FIG. 5, the system in FIG. 6 comprises an additional or second pair of parallel actuators and associated PCVs, namely actuators 454 and 474, and PCVs 522 and 534.

To operate the system using only the first pair of parallel actuators 414 and 434, this second pair of parallel actuators 454 and 474 may be disabled or deactivated, or at least disabled enough so as to not utilize pressurized fluid nor contribute to the output to the load, thus enabling the system to drive the load using only the necessary amount of pressurized fluid needed to actuate the actuators 414 and 434. In other words, pressurized fluid is preserved by only recruiting those actuators necessary to achieve or maintain operation of the load within a certain range of operating conditions, namely the range of operating conditions able to be provided by the first pair of parallel actuators 414 and 434. As explained herein, pressurized fluid is not needed to permit actuators 454 and 474 to go inactive or to be passive, yet still be able to displace. However, there may be instances where a small amount of pressurized fluid may be used. It is worth noting that with respect to a system where the pistons in the actuators are coupled to a rigid mechanical linkage (not shown, but also contemplated), it may be necessary to completely deactivate actuators 454 and 478.

To accomplish operation within the system using only the first pair of parallel actuators 414 and 434, PCVs 522 and 534 associated with the actuators 454 and 474, respectively, are caused to enter a valving state of inactive passivity (also described as a slosh mode), as explained above. In this mode, the pistons 462 and 482, respectively, may be permitted to displace within their respective actuator housings based on the principles of inactive passivity discussed herein in response to the kinetic energy generated from actuating actuators 414 and 434 and induced within actuators 454 and 474, without requiring additional pressurized fluid supplied to the associated PCVs 522 and 534 for actuation. The slosh mode for PCVs 522 and 534, as well as for any other similarly configured PCVs operating within the system 410, may be achieved by manipulating the pilot pressure in the PCVs to open the return ports, which pilot pressure is controlled by the respective pilot valves operable with the PCVs to provide a control or pilot pressure to the PCVs.

As the actuators 414 and 434 are operated to drive the load 582, and as the pistons 422 and 442 are coupled to the outer pulley 570, which is indirectly coupled to the inner pulley 575 through attachment of the linkage 578, or in other words as the load 582 and linkage 578 are coupled to each of the pulleys 570 and 574, the intended rotation of the outer pulley 570 will naturally cause the inner pulley 574 to also rotate, and vice versa. Therefore, although the tendon drive system relies upon flexible tendons 586 and 590, it may be desirable to supply just enough pressurized fluid to the actuators 454 and 474 to maintain tendon 590 in tension as the tendon drive system rotates back and forth. This will enable more efficient and responsive operation of the system 410 as the various available actuators go from a non-recruited, inactive state (e.g., inactive passivity) to a recruited, active state.

With parallel actuators 414 and 434 being smaller in size than parallel actuators 454 and 474, the system is able to provide a given output power (the relationship of force or torque and speed) $P_1$ to the load 582. However, the capabilities of actuators 414 and 434 will be limited in terms of its generated output power. As such, the load 582 will be able to be operational only within a certain range of operating conditions. When the operating conditions of the load 582 are beyond the capabilities of the system running solely on parallel actuators 414 and 434, the system 410 advantageously comprises the ability to recruit different sized and/or combinations of actuators for the purpose of varying the output power to the load, and optimizing its operating performance to meet the current condition.

In a similar manner as discussed above with respect to the first pair of parallel actuators 414 and 434, the second pair of parallel actuators 454 and 474 may be selectively actuated to provide additional power output to the load, the second pair of parallel actuators 454 and 474 being larger in size than the first pair of parallel actuators 414 and 434. Actuators 454 and 474 are operably coupled to the load via the tendon drive system, and particularly via tendon 590, which is operable about inner pulley 574. In conjunction with actuation of the second pair of parallel actuators 454 and 474, the first pair of parallel actuators 414 and 434 may be deactivated or disabled by causing the PCVs operable with these to enter the slosh mode, again in a similar manner as discussed above. Actuation of the second pair of parallel actuators 454 and 474 will enable the system 410 to supply a larger output power $P_2$ to the load 582 as a result of their different configuration or size. Although an increased amount of pressurized fluid may be needed to actuate actuators 454 and 474 and to provide the increase in output power to the load 582, the fluid amount is still able to be kept to a minimum as the actuators 454 and 474 will permit operation of the load within a given range of operating conditions, which range is different than the range provided by actuators 414 and 434 operating alone, and as the first pair of actuators and their PCVs are inactive (again, meaning little or no pressurized fluid is being used). As such, pressurized fluid is still preserved as compared to prior related servo or fluid control actuation systems.

The fluid control system 410, as shown, provides still another actuation state in addition to those just described. Specifically, to achieve the maximum power output to the load 582 as permitted by the system, it is contemplated that both the first pair of parallel actuators 414 and 434 and the second pair of parallel actuators 454 and 474 may be recruited in combination and actuated simultaneously to drive the load 582, and to permit operation of the load in yet another range of operating conditions. For instance, to drive the load in a clockwise direction (looking at FIG. 6), actuators 434 and 474 may be simultaneously actuated to simultaneously rotate inner and outer pulleys 570 and 574, and to simultaneously drive the load 582. Likewise, to drive the load in a counterclockwise direction (looking at FIG. 6), actuators 414 and 454 may be simultaneously actuated for the same purpose. The combination of the first and second pairs of parallel actuators functions to provide the load with maximum output power $P_3$ as multiple actuators are being used at the same time to drive the load in a given direction. The use of pressurized fluid is also at an increased amount as more fluid is needed to simultaneously actuate multiple actuators. However, at any time, one or more pairs of parallel actuators may be caused to go into an inactive passivity mode (slosh mode) as operating conditions change where maximum power is not needed, thus preserving fluid that would otherwise be required in prior related fluid control systems.

As such, it can be seen that a different output power and resulting range of operating conditions may be achieved for each pair of parallel actuators and the combination of pairs of parallel actuators. It is intended that where one actuation state, that has enabled the load to suitably operate within a given range of operating conditions, has reached its maximum output capabilities, and where additional output is needed or desired, that a different actuation state be made available to provide operation of the load within a different, more capable range of operating conditions than the previous. In effect, it is intended that the system be able to effectively shift gears into a more appropriate and capable actuation state, whether this be to provide more or less power or speed. In addition, it is intended that when a needed operating condition is no longer needed, that the system automatically revert to the most efficient actuation state available to still enable proper operation of the load given its current condition. For example, it may be desirable to recruit the combination of first and second pairs of parallel actuators in order to enable the load to exert a greater force (e.g., to enable one or more appendages of a robot or exoskeleton to lift an object, or facilitate the climbing of a flight of stairs). However, once the need for the increase in output power has been met, the system may be able to effectively "shift" to select a different pair or different combination of actuators that are more efficient for the current, less demanding operating condition. The same principle would apply for the different speeds that the load may need to achieve or maintain (e.g., running vs. walking).

In essence, it is intended that the system be able to adapt and recruit from the available actuators those needed to achieve or maintain any desired operating condition, but that the system also provide the most efficient transmissive actuation state for the current operating condition. Essentially, the system optimizes use of the pressurized fluid. What this means is that although a certain amount of fluid may be available for the most demanding of operating conditions (e.g., maximum torques or maximum speeds), additional fluid may be needed for less demanding operating conditions. Indeed, the more demanding the operating condition the more fluid that may be required to operate or actuate the one or more selected or recruited actuators configured to enable the load to operate in such conditions. On the other hand, in less demanding operating conditions, the system is able to recruit from a different sized, smaller actuator or combination of actuators that would still enable the load to operate, yet utilize less fluid due to other actuators being inactive, thus allowing the system to operate in a much more efficient manner by only using the fluid that is needed. In effect, the system adjusts or changes gears to accommodate different operating conditions and to optimize efficiency, which gears are provided by the selective recruitment of one or more pairs of parallel actuators.

Figure 7:
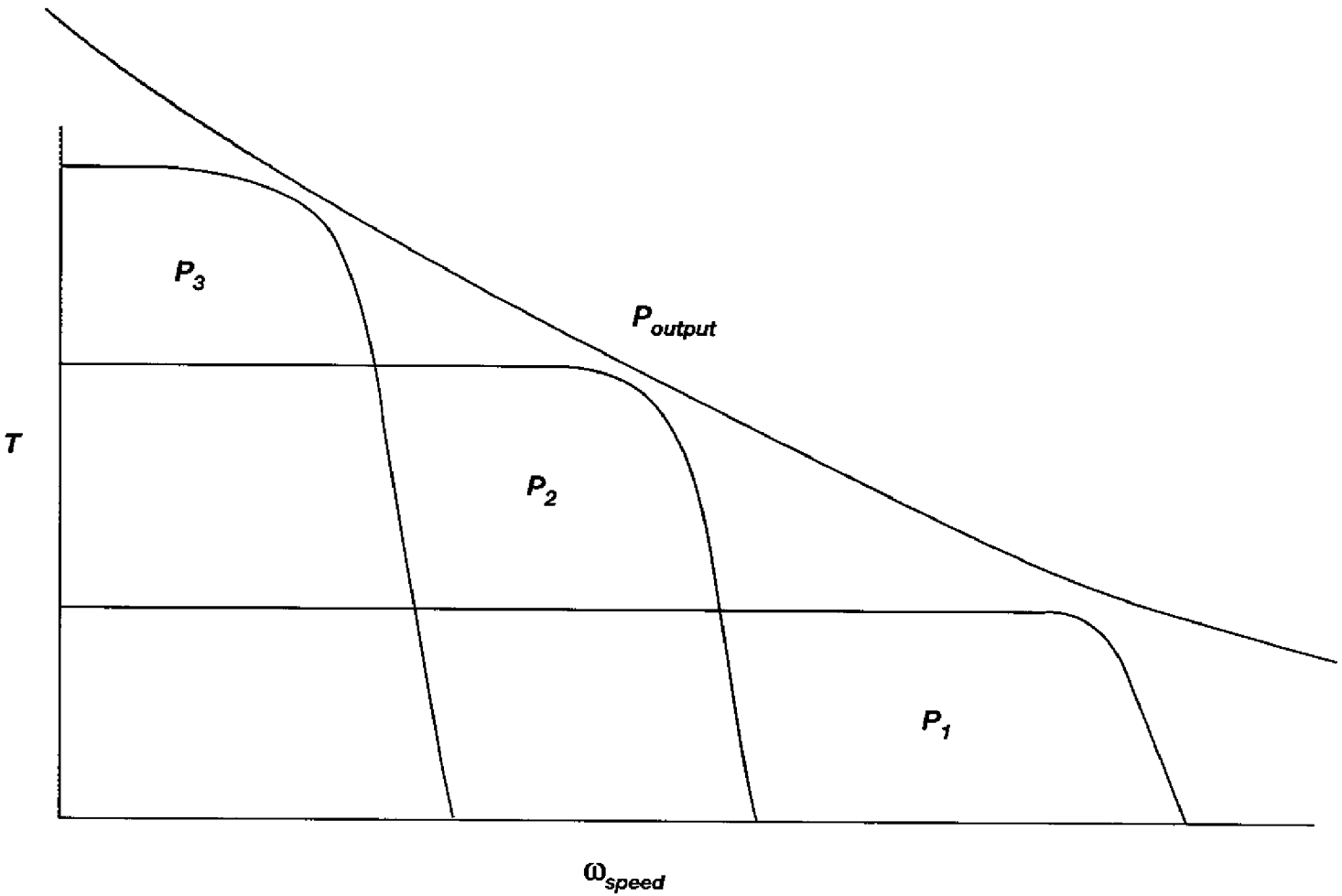
FIG. 7 illustrates a graph plotting output power of the various output levels or states of the fluid control system of FIG. 6, depending upon the actuators recruited.

With reference to FIG. 7, illustrated is a diagram depicting, generally, the variable output power ranges of the fluid control system of the present invention, in accordance with one exemplary embodiment. As shown, FIG. 7 illustrates the various power outputs described above in relation to FIG. 6. The output $P_1$ generated by recruitment of the first pair of parallel actuators provides relatively low torque T, but high speeds ω. The output $P_2$ generated by recruitment of the second pair of parallel actuators provides an increase of torque T over $P_1$, but does so at slower speeds ω. Finally, the output power P3 generated by recruitment of both the first and second pairs of parallel actuators provides the maximum amount of torque T, but the slowest speeds ω. Power outputs $P_1$, $P_2$ and $P_3$ provide a power output curve for the fluid control system as illustrated.

Figure 8:
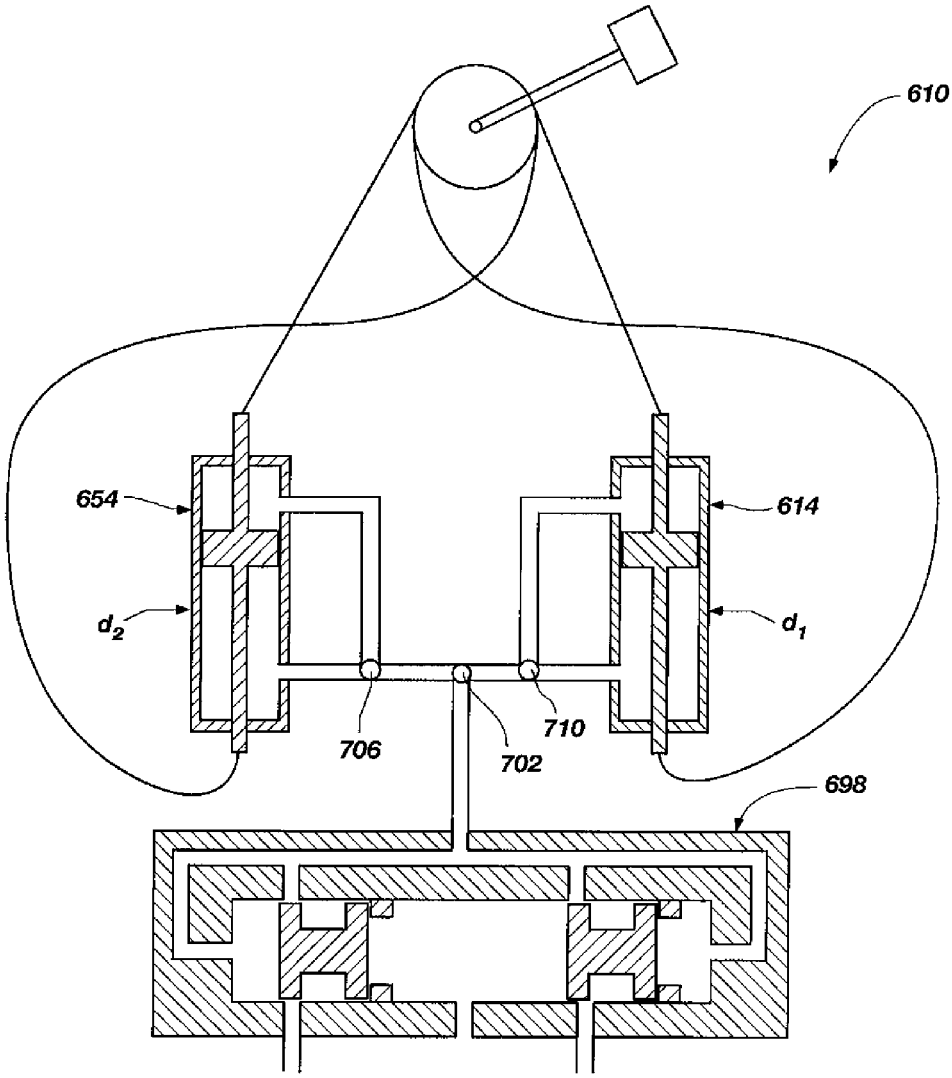
FIG. 8 illustrates a generalized diagram of a fluid control system in accordance with another exemplary embodiment of the present invention, wherein a single pressure control valve is used to control different sized parallel, antagonistic actuators.

With reference to FIG. 8, illustrated is a fluid control system in accordance with another exemplary embodiment of the present invention. In this embodiment, the fluid control system 610 comprises parallel actuators 614 and 654 antagonistic to one another and operable with a tendon drive system, similar to the one discussed above. However, unlike providing a PCV for each actuator, this embodiment contemplates a single PCV that is able to operate each of the actuators 614 and 654 independent of one another. In other words, the PCV is capable of bilateral control or bilateral pressure regulation. The fluid control system 610 comprises a series of valves, such as directional valves, used to govern or control the direction of the pressurized fluid from the PCV.

The actuator 614 comprises a different size $d_1$ than the actuator 654, having a size $d_2$, thus enabling the system to effectuate transmissive actuation and achieve variable output for efficiency and other purposes as discussed above. In a first actuation state, actuator 614 is actuated with valve 702 operable to direct pressurized fluid from the PCV 698 to the actuator 614. Valve 710 further controls on which side of the piston that the pressurized fluid enters the actuator housing. By actuating valve 710 and alternating the input of the fluid into the actuator housing on each side of the piston, the piston can be displaced within the actuator housing in both directions, thus driving the load in both directions.

Likewise, in a second actuation state, actuator 654, of a different size, may be actuated, with valve 702 being operable to direct pressurized fluid from the PCT 698 to the actuator 654. Valve 706 further controls on which side of the piston the pressurized fluid enters the actuator housing. Like actuator 614, actuator 654 is able to effectuate bi-directional displacement of the piston supported therein, and to drive the load in both directions.

It is noted that the tendons of the tendon drive system are not indicative of actual positioning with respect to the pistons and the pulley, but are instead intended to illustrate that each piston in each actuator 614 and 654 is intended to be coupled to the pulley in a manner to facilitate rotation in both directions. This will be obvious to one skilled in the art.

Figure 9:
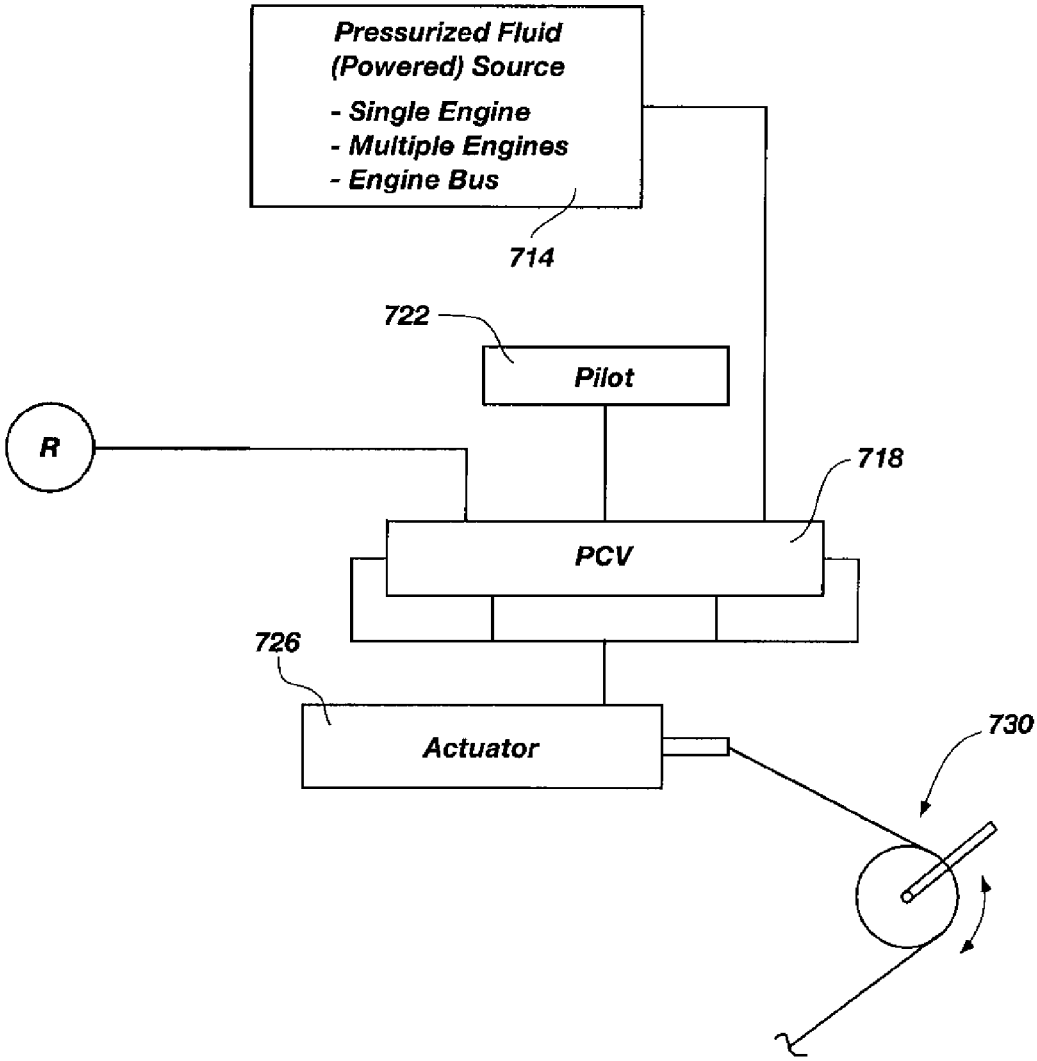
FIG. 9 illustrates a general block diagram depicting a powered actuation system and the use of a powered pressurized fluid source utilized to provide pressurized fluid to a pressure control valve, which is configured to regulate the pressure and flow of pressurized fluid in and out of one or more actuators operable with a load.

With reference to FIG. 9, illustrated is a diagram depicting the use of a powered pressurized fluid source 714 utilized to provide pressurized fluid to a PCV 718, which is configured to regulate the pressure and flow of pressurized fluid in and out of one or more actuators operable with a load, which components may collectively be referred to herein as a powered actuator system. The powered pressurized fluid source 714 may comprise a single internal combustion engine, multiple internal combustion engines, or multiple internal combustion engines supplying fluid via a fluid bus. Various applicable internal combustion engines suitable for implementation with the present invention are disclosed in patents and applications for patent owned by Sarcos LC of Salt Lake City, Utah.

In one aspect, the internal combustion engine may comprise a local compressor. In another aspect, the internal combustion engine may comprise a remote compressor that receives fuel from fuel source, compresses it, and transfers it into the combustion portion of a chamber through a fuel line. The powered pressurized fluid source 714 functions to deliver pressurized fluid to the PCV 718. The powered pressurized fluid source receives pressurized fluid from a reservoir. Upon being actuated or powered, the powered pressurized fluid source pumps pressurized fluid to the PCV at various select pressures.

The PCV 718 is configured as described above, and is operable with pilot valve 722 to control the pressure within the actuator 726, and to actuate the piston supported therein, which in turn, operates the tendon drive system 730 to operate or drive the load.

The powered fluid source is capable of generating large amounts of energy in quick bursts or in a more steady or constant manner, depending upon the timing of the combustion and the throttling of the system. This rapid energy generation function is preferably transferred or converted through a rapid power conversion system to achieve rapid output power that is received by a hydraulic pump used to provide the pressurized fluid to the PCV. The hydraulic pump rapidly responds by providing the necessary pressure into the PCV to accurately and timely drive the actuator and ultimately the load. The use of a high power rapid fire power conversion system is advantageous in this respect in that the actuator is capable of driving the load using large amounts of power received in short amounts of time and on demand. Therefore, there are few losses in the system between the internal combustion engine and the actual driving of the actuator and load, as well as an increase in output power. For example, without describing the specific functions of the pilot and pressure control valves, if the load was to be continuously driven or held in place to overcome gravitational forces, a rapid fire internal combustion engine could be continuously throttled to produce constant energy that may be converted into usable power. The pump would be continuously operated to supply the necessary pressurized fluids needed to sustain the actuator in the drive mode.

In another example, if the actuator was to be actuated and the load driven periodically (either randomly or in systematic bursts), a rapid fire internal combustion engine could be periodically throttled to produce rapid bursts of energy. In this example, the pump would be periodically operated to supply the necessary pressurized fluid needed to drive the actuator for a specified or pre-determined amount of time. The advantage of the rapid fire internal combustion engine coupled with the rapid response and energy extraction through a power conversion device, is that the system is capable of producing large and explosive amounts of output power in a short amount of time.

Figure 10:
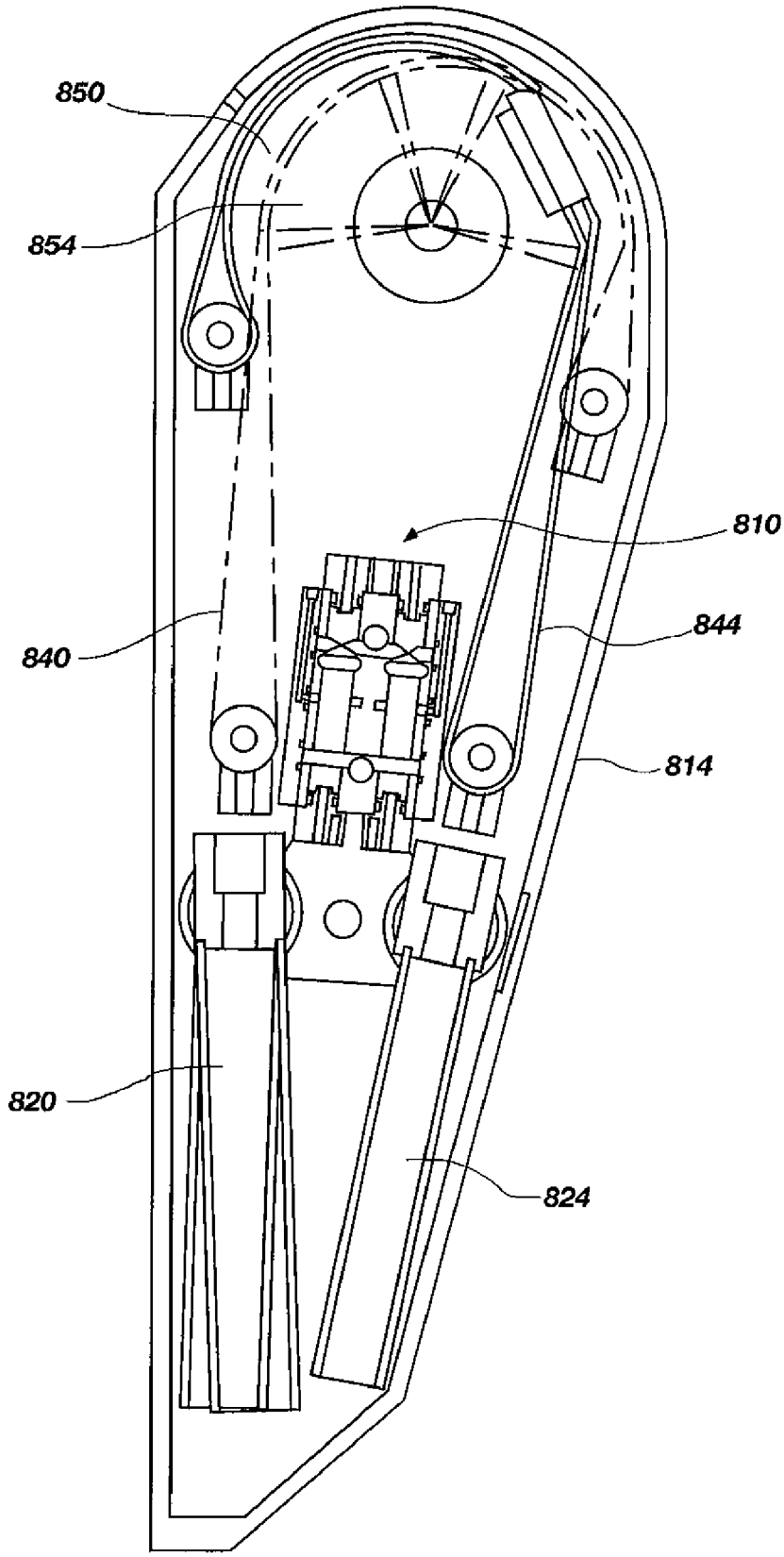
FIG. 10 illustrates an exemplary leg of an exemplary robotic exoskeleton incorporating one embodiment of the fluid control system of the present invention.

With reference to FIG. 10 illustrated is an exemplary application utilizing the fluid control system of the present invention, as described herein. In this particular application, the fluid control system 810 is supported and operable within an exoskeleton (not shown in its entirety), and particularly a leg 814 of the exoskeleton. The fluid control system 810 is used to control the parallel actuators within the system (the FIG. illustrates the first pair of parallel actuators 820 and 824, but does not illustrate the second pair of parallel actuators that are present in the system), each of which are coupled to a tendon drive system, respectively. Within the tendon drive system, tendons 840 and 844 are operably coupled to pulleys 850 and 854, respectively, at one end, and the first and second pairs of parallel actuators, respectively, at an opposite end. The actuators are fluidly coupled to the fluid control system 810, and more particularly to the individual PCVs contained therein, via the output/load pressure ports. The pressure in the output/load pressure ports is used to drive the pistons (not shown) within the cylinders of the actuators. Using pressure control from the fluid control system 810, the actuators are selectively recruited and caused to actuate to drive the tendons 840 and 844 attached thereto to rotate the pulleys 750 and 754, which function to power the limb or leg 814 of the exoskeleton. Any one or all of the actuators contained within the pressure control system 810 may be selectively recruited to control the tendon drive system and drive the load.

Shifting Logic and Control Algorithms

The present invention also features one or more control algorithms designed to monitor operating conditions and to control the selective recruitment of the actuators for a given or desired operating condition of the load. These control algorithms essentially provide a highly precise shifting logic that maximizes the performance of the fluid control system with respect to any given or desired operating condition of the load (e.g., to perform a current task, such as walking, running, lifting, etc. within a robotic system) by determining which actuators to recruit and when, with the goal of preserving as much pressurized fluid as possible, and optimizing efficiency. The control algorithm essentially functions to determine which actuators to recruit at any given time so that the minimal amount of pressurized fluid is used at all times to move the load a given distance and/or at a given speed. The control algorithm may determine whether higher forces or torque is needed/desired, and/or whether faster or slower speeds are needed/desired. The control algorithm then controls the recruitment of those available actuators that are best able to provide the needed operating condition, but with the least amount of pressurized fluid.

In one aspect, the shifting logic may comprise pre-programmed or pre-determined output levels for achieving a desired output and operating condition. In another aspect, the shifting logic may comprise a feedback system that continually monitors the current operating condition of the load and then effectuates adjustment of the output upon an as needed basis. A combination of these is also contemplated in which the load can be caused to perform in a desired manner, with feedback allowing operators to maximize the operating condition.

In one embodiment, a computer may be configured to continuously monitor various input parameters, namely those created by the present conditions in which the load is operating, for the purpose of determining the proper output. For example, input parameters may be received by monitoring current levels of torque and speed of the load and/or the actuators. Based on these, the computer may then determine if the current actuator(s) are appropriate to produce the needed output, or if the system needs to modify the number and/or type of actuators being recruited. Essentially, the computer is able to recruit accordingly from the available actuators, with the logic being to select those actuators that will enable the load to operate correctly or productively, but that will also enable the system to preserve the maximum amount of pressurized fluid. This process continues with the control algorithm signaling the system to recruit the appropriate actuator or combination of actuators for any given or needed operating condition, as well as changing operating conditions. The system may be configured to default to the most efficient type and number of actuators, with variations or adjustments in actuator recruitment coming as needed, such as to increase torque or speed. Once such adjustments are not needed (e.g., increased torque or speed is no longer needed), and more efficient actuator(s) may be used, the system adjusts to recruit the most efficient actuator or combination of actuators. In this way, fluid efficiency is increased as only the smallest amount of fluid needed to actuate the recruited actuators is provided by the system. In other words, fluid is preserved. In addition, the parameters of the system are optimized. For example, if a certain torque is desired, the speed may then be optimized. Likewise, if a certain speed is desired, the force or torque may be optimized. All of this is intended to be controlled by a suitable control algorithm.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given above.

What is claimed and desired to be secured by Letters Patent is:

1. A fluid control system adapted to optimize power output for a given operating condition, comprising:

a load;

a first pair of parallel actuators operating antagonistic to one another, and operable with said load;

a second pair of parallel actuators operating antagonistic to one another, and operable with said load, said second pair of parallel actuators comprising a different size than said first pair of parallel actuators;

at least one pressure control valve operable with each pair of said first and second pairs of parallel actuators and a pressurized fluid source, wherein said at least one pressure control valve provides a continuously variable pressure to said parallel actuators that facilitates a continuous range of output forces;

means for operably coupling said first and second pairs of actuators to said load; and a control algorithm operable to recruit from said first and second pairs of parallel actuators to achieve variable power output, and to separately recruit and actuate either of said first and second pairs of parallel actuators, as well as a combination of said first and second pairs of parallel actuators.

2. The fluid control system of claim 1, wherein one or more pressure control valves operable with a non-recruited pair of parallel actuators are caused to enter a valving state of inactive passivity that permits said non-recruited pair of parallel actuators to displace, without active input, simultaneously with a recruited pair of parallel actuators being actuated by active input.

3. The fluid control system of claim 1, wherein said means for operably coupling said first and second pairs of actuators to said load comprises a tendon drive system.

4. The fluid control system of claim 3, wherein said tendon drive system comprises:

a first tendon and first pulley operable with said first pair of parallel actuators; and a second tendon and second pulley operable with said second pair of parallel actuators, said first and second pulleys being operably coupled to said load.

5. The fluid control system of claim 4, wherein said first and second pulleys comprise a different size to facilitate a mechanical advantage.

6. The fluid control system of claim 1, wherein said means for operably coupling said first and second pairs of actuators to said load comprises a mechanical linkage system.

7. The fluid control system of claim 1, wherein said control algorithm is adapted to optimize fluid conservation for a given output power, and within said given operating condition.

8. The fluid control system of claim 1, wherein said pressure control valve comprises:

a valve body;

a return spool freely supported within said valve body;

a pressure spool, independent of said return spool, and freely supported within said valve body, each of said return and pressure spools being movable within said valve body in accordance with a pressure differential present across said return and pressure spools, respectively; and an intrinsic feedback system operating to exert a feedback force on said return and pressure spools in response to said pressure differential in an attempt to equalize said pressure differential.

9. The fluid control system of claim 1, wherein said pressure control valve comprises:

a valve body having an asymmetric configuration, such that a return valving component of said valve body comprises a greater size than a pressure valving component of said valve body, said valve body having return and pressure inlet and outlet ports formed therein for fluidly communicating with an interior cavity of said valve body;

a return spool freely supported within an interior cavity of said return valving component of said valve body and configured to regulate fluid flow through said return inlet and outlet ports; and a pressure spool, independent of said return spool, and freely supported within an interior cavity of said pressure valving component of said valve body, said pressure spool configured to regulate fluid flow through said pressure inlet and outlet ports, said return spool being greater in size than said pressure spool and corresponding in size to said return valving component, said pressure spool corresponding in size to said pressure valving component.

10. The fluid control system of claim 1, wherein said pressure control valve comprises:

a valve body having return and pressure inlet and outlet ports and first and second feedback ports formed therein for fluidly communicating with an interior cavity of said valve body;

a return spool freely supported within said valve body and configured to regulate fluid flow through said return inlet and outlet ports;

a pressure spool, independent of said return spool, and freely supported within said valve body opposite said return spool, said pressure spool configured to regulate fluid flow through said pressure inlet and outlet ports;

an intrinsic pressure feedback system configured to displace said return and pressure spools in response to a pressure differential created between a pilot pressure and a feedback pressure concurrently acting on opposing sides of said return and pressure spools, said intrinsic pressure feedback system configured to dissipate said pressure differential and equalize said pilot pressure and said feedback pressure; and limiting means located within said valve body and configured to establish limiting positions of said return and pressure spools within said valve body during various valving states.

11. A fluid control system adapted to optimize power output for a given operating condition, comprising:

a load;

a first actuator operable with said load;

a second actuator operable with said load, and operating antagonistic to said first actuator, said first and second actuators comprising a different size;

a pressure control valve operable with each of said first and second actuators, and a pressurized fluid source, wherein said pressure control valve provides a continuously variable pressure to said first and second actuators that facilitates a continuous range of output forces;

means for operably coupling said first and second actuators to said load; and a control algorithm operable to recruit and actuate either of said first and second actuators to achieve variable power output.

12. A method for varying power output within a fluid control system operable with a load, said method comprising:

providing a first pair of parallel actuators operating antagonistic to one another, and operable with said load;

providing a second pair of parallel actuators operating antagonistic to one another, and operable with said load, said second pair of parallel actuators comprising a different size than said first pair of parallel actuators;

operating at least one pressure control valve with each pair of said first and second pairs of parallel actuators and a pressurized fluid source, wherein said at least one pressure control valve provides a continuously variable pressure to said parallel actuators that facilitates a continuous range of output forces;

coupling said first and second pairs of actuators to said load; and recruiting, selectively, from said first and second pairs of parallel actuators to achieve a variable power output, said recruiting being capable of separately recruiting and actuating either of said first and second pairs of parallel actuators, as well as a combination of said first and second pairs of parallel actuators.

13. The method of claim 12, further comprising causing one or more pressure control valves operable with a non-recruited pair of parallel actuators to enter a valving state of inactive passivity that permits said non-recruited pair of parallel actuators to displace, without active input, simultaneously with a recruited pair of parallel actuators being actuated by active input.

14. The method of claim 12, further comprising coupling said first and second pairs of actuators to said load via a tendon drive system.

15. The fluid control system of claim 14, wherein said tendon drive system comprises:

a first tendon and first pulley operable with said first pair of parallel actuators; and a second tendon and second pulley operable with said second pair of parallel actuators, said first and second pulleys being operably coupled to said load.

16. The method of claim 12, further comprising utilizing a control algorithm adapted to control said recruiting, selectively, from said first and second pairs of parallel actuators.

17. A method for varying power output within a fluid control system operable with a load, said method comprising:

recruiting a first pair of parallel actuators to achieve a first power output;

recruiting a second pair of parallel actuators, having different size than said first pair of parallel actuators, to achieve a second power output;

recruiting, in combination, said first and second pairs of parallel actuators to achieve a third power output;

causing a pressure control valve operable with said second pair of parallel actuators to enter a state of inactive passivity during said recruiting of said first pair of parallel actuators to achieve said first power output; and causing a pressure control valve operable with said first pair of parallel actuators to enter a state of inactive passivity during said recruiting of said second pair of parallel actuators to achieve said second power output, wherein said pressure control valve operable with said second pair of parallel actuators provides a continuously variable pressure to said second pair of parallel actuators that facilitates a continuous range of output forces, said range comprising said second power output.

18. The method of claim 17, further comprising maintaining at least some active input to said pressure control valves during said state of inactive passivity.

19. The method of claim 17, further comprising selectively alternating between said recruiting said first pair of parallel actuators, said recruiting said second pair of parallel actuators, and said recruiting, in combination, said first and second pairs of parallel actuators to achieve selective variable power outputs as needed, and in response to given operating conditions.

20. The method of claim 17, further comprising recruiting only those pairs of parallel actuators necessary to maintain operation of said load within a certain range of operating conditions, and to preserve the greatest amount of pressurized fluid.

21. The method of claim 17, further comprising reverting to the most efficient actuation state available to still enable proper operation of said load given a current operating condition, said reverting comprising recruiting an appropriate pair or combination of pairs of parallel actuators.

* * * * *